US011664140B2

(12) United States Patent
Sakuma et al.

(10) Patent No.: US 11,664,140 B2
(45) Date of Patent: May 30, 2023

(54) RARE EARTH MAGNET AND MANUFACTURING METHOD THEREFOR

(71) Applicant: TOYOTA JIDOSHA KABUSHIKI KAISHA, Toyota (JP)

(72) Inventors: Noritsugu Sakuma, Mishima (JP); Tetsuya Shoji, Susono (JP); Akihito Kinoshita, Mishima (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 13 days.

(21) Appl. No.: 17/182,993

(22) Filed: Feb. 23, 2021

(65) Prior Publication Data

US 2021/0327620 A1 Oct. 21, 2021

(30) Foreign Application Priority Data

Apr. 21, 2020 (JP) ..... JP2020-075583

(51) Int. Cl.

| | |
|---|---|
| ***H01F 1/057*** | (2006.01) |
| ***H01F 41/02*** | (2006.01) |
| ***C22C 38/00*** | (2006.01) |
| ***H01F 1/058*** | (2006.01) |

(52) U.S. Cl.

CPC ..... *H01F 1/0577* (2013.01); *C22C 38/005* (2013.01); *H01F 1/058* (2013.01); *H01F 41/0266* (2013.01); *H01F 41/0293* (2013.01)

(58) Field of Classification Search

None

See application file for complete search history.

(56) References Cited

U.S. PATENT DOCUMENTS

| | | | | |
|---|---|---|---|---|
| 2014/0311291 | A1 | 10/2014 | Enokido et al. | |
| 2016/0141083 | A1 | 5/2016 | Ito et al. | |
| 2018/0182519 | A1* | 6/2018 | Ito | H01F 41/0293 |
| 2018/0308633 | A1* | 10/2018 | Ito | C22C 38/06 |

FOREIGN PATENT DOCUMENTS

| | | | |
|---|---|---|---|
| CN | 111210963 | A | 5/2020 |
| EP | 3 522 178 | A1 | 8/2019 |
| JP | 2011-211068 | A | 10/2011 |
| JP | 2014-216339 | A | 11/2014 |
| JP | 2018-182299 | A | 11/2018 |
| KR | 10-2019-0080748 | A | 7/2019 |
| WO | 2014/196605 | A1 | 12/2014 |

* cited by examiner

*Primary Examiner* — Xiaowei Su

(74) *Attorney, Agent, or Firm* — Oliff PLC

(57) ABSTRACT

A rare earth magnet includes a main phase and a particle boundary phase and in which an overall composition is represented by a formula, $(R^2_{(1-x)}R^1_x)_yFe_{(100-y-w-z-v)}Co_wB_zM^1_v\cdot(R^3_{(1-p)}M^2_p)_q\cdot(R^4_{(1-s)}M^3_s)_t$, where $R^1$ is a light rare earth element, $R^2$ and $R^3$ are a medium rare earth element, $R^4$ is a heavy rare earth element, $M^1$, $M^2$, $M^3$ are a predetermined metal element. The main phase includes a core portion, a first shell portion, and a second shell portion. The content proportion of medium rare earth element is higher in the first shell portion than in the core portion, the content proportion of medium rare earth element is lower in the second shell portion than in the first shell portion. The second shell portion contains heavy rare earth elements.

10 Claims, 11 Drawing Sheets

RARE EARTH MAGNET AND MANUFACTURING METHOD THEREFOR

CROSS-REFERENCE TO RELATED APPLICATION

This application claims priority to Japanese Patent Application No. 2020-075583 filed on Apr. 21, 2020, incorporated herein by reference in its entirety.

BACKGROUND

1. Technical Field

The present disclosure relates to a rare earth magnet and a manufacturing method therefor. The present disclosure particularly relates to an R—Fe—B-based rare earth magnet (where R is a rare earth element) having an excellent coercive force and a manufacturing method therefor.

2. Description of Related Art

An R—Fe—B-based rare earth magnet includes a main phase and a particle boundary phase present around the main phase. The main phase is a magnetic phase having a crystal structure of an $R_2Fe_{14}B$ type. High residual magnetization is obtained by this main phase.

Among the R—Fe—B-based rare earth magnets, the most general magnet having an excellent balance between performance and price is an Nd—Fe—B-based rare earth magnet in which Nd is selected as R (hereinafter referred to as "neodymium magnet"). For this reason, neodymium magnets have been rapidly widespread, and the amount of Nd used has increased sharply. The amount of Nd to be used may exceed the amount of Nd to be produced in the future. Accordingly, various attempts have been made to substitute a part of the amount of Nd with light rare earth elements, such as Ce, La, Y, and Sc.

For example, Japanese Unexamined Patent Application Publication No. 2014-216339 (JP 2014-216339 A) discloses a (Nd,Ce)—Fe—B-based rare earth magnet in which a part of Nd's in the main phase are substituted with Ce. The (Nd,Ce)—Fe—B-based rare earth magnet disclosed in JP 2014-216339 A is obtained by sintering a magnetic powder having a main phase having a microlevel particle size at a high temperature (1,000° C. to 1,200° C.) for long hours (8 to 50 hours). Due to this long-term sintering at the high temperature, the main phase of the (Nd,Ce)—Fe—B-based rare earth magnet disclosed in JP 2014-216339 A has a core/shell structure, and the existence proportion of Nd is higher in the shell portion than in the core portion.

In addition, WO 2014/196605 discloses a rare earth magnet manufactured by diffusing and permeating a modifying material containing a rare earth element other than light rare earth elements into the inside of an R—Fe—B-based rare earth magnet, as a precursor, which contains a light rare earth element. As a specific example, WO 2014/196605 discloses a rare earth magnet manufactured by diffusing and permeating a melt of a Nd—Cu alloy, as the modifying material, into the inside of a (Nd,Ce)—Fe—B-based rare earth magnet precursor.

In the specific example disclosed in WO 2014/196605, the main phase has a core/shell structure, and the existence proportion of Nd is higher in the shell portion than in the core portion since the Nd—Cu alloy is diffused and permeated, as the modifying material, into the (Nd,Ce)—Fe—B-based rare earth magnet precursor.

In addition, the main phase of the rare earth magnet precursor used in the specific example disclosed in WO 2014/196605 is nano crystallized. Further, the rare earth magnet precursor is hot-plastically processed in advance to impart anisotropy before diffusing and permeating the modifying material.

SUMMARY

In a case where the main phase in the (Nd,Ce)—Fe—B-based rare earth magnet does not have a core/shell structure such a structure in the (Nd,Ce)—Fe—B-based rare earth magnet disclosed in JP 2014-216339 A, coercive force is reduced. This is because the anisotropic magnetic field of $Ce_2Fe_{14}B$ is smaller than the anisotropic magnetic field of $Nd_2Fe_{14}B$.

On the other hand, in a case where the main phase has a core/shell structure and the existence proportion of Nd is higher in the shell portion than in the core portion, as in the case of the (Nd,Ce)—Fe—B-based rare earth magnet disclosed in WO 2014/196605, the coercive force reduced by the inclusion of Ce can be compensated. This is because in a case where the existence proportion of Nd is higher in the shell portion than in the core portion, the anisotropic magnetic field is higher in the shell portion than in the core portion, and thus it is possible to suppress the generation of the inversely magnetized nucleus on the surface of the main phase particle and the growth of the nucleus in the adjacent main phase particle.

However, in the R—Fe—B-based rare earth magnet in which a part of at least ones of Nd's or Pr's are substituted with a light rare earth element, such as Ce, a further increase in coercive force is demanded.

The present disclosure provides a rare earth magnet in which a part of at least ones of Nd's or Pr's are substituted with a light rare earth element, such as Ce, in an R—Fe—B-based rare earth magnet, and coercive force is further increased, and a manufacturing method for the rare earth magnet.

The rare earth magnet and the manufacturing method for the rare earth magnet of the present disclosure include aspects below.

A first aspect of the present disclosure relates to a rare earth magnet. The rare earth magnet includes a main phase and a particle boundary phase present around the main phase.

In the aspect, an overall composition in terms of the molar ratio is represented by a formula, $(R^2_{(1-x)}R^1_x)_yFe_{(100-y-w-z-v)}Co_wB_zM^1_v\cdot(R^3_{(1-p)}M^2_p)_q\cdot(R^4_{(1-s)}M^3_s)_t$, (provided that $R^1$ is one or more elements selected from the group consisting of Ce, La, Y, and Sc; $R^2$ and $R^3$ are one or more elements selected from the group consisting of Nd and Pr; $R^4$ is a rare earth element at least including one or more elements selected from the group consisting of Gd, Tb, Dy, and Ho; $M^1$ is one or more elements selected from the group consisting of Ga, Al, Cu, Au, Ag, Zn, In, and Mn, and an unavoidable impurity element; $M^2$ is a metal element other than rare earth elements, which is alloyed with $R^3$, and an unavoidable impurity element; and $M^3$ is a metal element other than rare earth elements, which is alloyed with $R^4$, and an unavoidable impurity element; and the followings are satisfied, $$0.1 \le x \le 1.0,$$

$$12.0 \le y \le 20.0,$$

$$5.0 \le z \le 20.0,$$

$0 \leq w \leq 8.0$, $0 \leq v \leq 2.0$, $0.05 \leq p \leq 0.40$, $0.1 \leq q \leq 15.0$, $0.05 \leq s \leq 0.40$, and $0.1 \leq t \leq 5.0$).

In the rare earth magnet, the main phase has a crystal structure of an $R_2Fe_{14}B$ type (where R is a rare earth element), an average particle size of the main phase is 0.1 μm to 20 μm, and the main phase has a core portion, a first shell portion present around the core portion, and a second shell portion present around the first shell portion.

In the rare earth magnet, a total of molar ratios of Nd and Pr in the first shell portion is higher than a total of molar ratios of Nd and Pr in the core portion, and a total of molar ratios of Nd and Pr in the second shell portion is lower than a total of molar ratios of Nd and Pr in the first shell portion.

In the rare earth magnet, the second shell portion contains one or more elements selected from the group consisting of Gd, Tb, Dy, and Ho, a total of molar ratios of Gd, Tb, Dy, and Ho in the second shell portion is higher than a total of molar ratios of Gd, Tb, Dy, and Ho in the core portion, and a total of molar ratios of Gd, Tb, Dy, and Ho in the second shell portion is higher than a total of molar ratios of Gd, Tb, Dy, and Ho in the first shell portion.

In the rare earth magnet according to the first aspect, the x may be $0.5 \leq x \leq 1.0$.

In the rare earth magnet according to the first aspect, the R may be one or more elements selected from the group consisting of Ce and La, the $R^2$ and the $R^3$ may be Nd, and the $R^4$ may be one or more elements selected from the group consisting of Tb and Nd.

In the rare earth magnet according to the first aspect, a total of molar ratios of Nd and Pr in the first shell portion may be 1.2 times to 3.0 times a total of molar ratios of Nd and Pr in the core portion, and a total of molar ratios of Nd and Pr in the second shell portion may be 0.5 times to 0.9 times the total of molar ratios of Nd and Pr in the first shell portion.

In addition, a total of molar ratios of Gd, Tb, Dy, and Ho in the second shell portion may be at least 2.0 times the total of molar ratios of Gd, Tb, Dy, and Ho in the core portion, and a total of molar ratios of Gd, Tb, Dy, and Ho in the second shell portion may be at least 2.0 times the total of molar ratios of Gd, Tb, Dy, and Ho in the first shell portion.

A second aspect of the disclosure relates to a manufacturing method for the aspect including, preparing a first rare earth magnet precursor and preparing a first modifying material, and diffusing and permeating the first modifying material into the first rare earth magnet precursor.

The first rare earth magnet precursor includes a main phase and a particle boundary phase present around the main phase and an overall composition of the first rare earth magnet precursor in terms of the molar ratio is represented by a formula, $(R^2_{(1-x)}R^1_x)_yFe_{(100-y-w-z-v)}Co_wB_zM^1_v.(R^3_{(1-p)}M^2_p)_q$, (provided that $R^1$ is one or more elements selected from the group consisting of Ce, La, Y, and Sc; $R^2$ and $R^3$ are one or more elements selected from the group consisting of Nd and Pr; $M^1$ is one or more elements selected from the group consisting of Ga, Al, Cu, Au, Ag, Zn, In, and Mn, and an unavoidable impurity element; and $M^2$ is a metal element other than rare earth elements, which is alloyed with $R^3$, and an unavoidable impurity element; and the followings are satisfied, $0.1 \leq x \leq 1.0$, $12.0 \leq y \leq 20.0$, $5.0 \leq z \leq 20.0$, $0 \leq w \leq 8.0$, $0 \leq v \leq 2.0$, $0.05 \leq p \leq 0.40$, and $0.1 \leq q \leq 15.0$).

In addition, the main phase has a crystal structure of an $R_2Fe_{14}B$ type (where R is a rare earth element), an average particle size of the main phase is 0.1 μm to 20 μm, the main phase includes a core portion and a first shell portion present around the core portion, and a total of molar ratios of Nd and Pr in the first shell portion is higher than a total of molar ratios of Nd and Pr in the core portion.

The first modifying material has a composition represented by a formula, $R^4_{(1-s)}M^3_s$, in terms of the molar ratio (provided that $R^4$ is a rare earth element at least including one or more elements selected from the group consisting of Gd, Tb, Dy, and Ho; $M^3$ is a metal element other than rare earth elements, which is alloyed with $R^4$, and an unavoidable impurity element; and the following is satisfied, $0.05 \leq s \leq 0.40$).

The manufacturing method according to the second aspect may further include preparing a second rare earth magnet precursor and preparing a second modifying material, and diffusing and permeating the second modifying material into the second rare earth magnet precursor to obtain the first rare earth magnet precursor.

The second rare earth magnet precursor may include a main phase and a particle boundary phase present around the main phase and an overall composition of the second rare earth magnet precursor in terms of the molar ratio may be represented by a formula, $(R^2_{(1-x)}R^1_x)_yFe_{(100-y-w-z-v)}Co_wB_zM^1_v$, (provided that $R^1$ is one or more elements selected from the group consisting of Ce, La, Y, and Sc; $R^2$ is one or more elements selected from the group consisting of Nd and Pr; $M^1$ is one or more elements selected from the group consisting of Ga, Al, Cu, Au, Ag, Zn, In, and Mn, and an unavoidable impurity element; and the followings are satisfied, $0.1 \leq x \leq 1.0$, $12.0 \leq y \leq 20.0$, $5.0 \leq z \leq 20.0$, $0 \leq w \leq 8.0$, and $0 \leq v \leq 2.0$), and the main phase may have a crystal structure of an $R_2Fe_{14}B$ type (where R is a rare earth element), and an average particle size of the main phase may be 0.1 μm to 20 m.

The second modifying material may have a composition represented by a formula, $R^3_{(1-p)}M^2_p$, in terms of the molar ratio (provided that $R^3$ is one or more elements selected from the group consisting of Nd and Pr; $M^2$ is a metal element other than rare earth elements, which is alloyed with $R^3$, and an unavoidable impurity element; and the following is satisfied, $0.05 \leq p \leq 0.40$).

The manufacturing method according to the second aspect may further include preparing a second rare earth magnet precursor powder and preparing a second modifying material powder, and mixing the second rare earth magnet precursor powder with the second modifying material powder to obtain the first rare earth magnet precursor.

The second rare earth magnet precursor powder may include a main phase and a particle boundary phase present around the main phase and an overall composition of the second rare earth magnet precursor in terms of the molar ratio may be represented by a formula, $(R^2_{(1-x)}R^1_x)_y Fe_{(100-y-w-z-v)}Co_wB_zM^1_v$, (provided that R is one or more elements selected from the group consisting of Ce, La, Y, and Sc; $R^2$ is one or more elements selected from the group consisting of Nd and Pr; $M^1$ is one or more elements selected from the group consisting of Ga, Al, Cu, Au, Ag, Zn, In, and Mn, and an unavoidable impurity element; and the followings are satisfied, $0.1 \leq x \leq 1.0$, $12.0 \leq y \leq 20.0$, $5.0 \leq z \leq 20.0$, $0 \leq w \leq 8.0$ and $0 \leq v \leq 2.0$), and the main phase may have a crystal structure of an $R_2Fe_{14}B$ type (where R is a rare earth element), and an average particle size of the main phase may be 0.1 μm to 20 m.

The second modifying material powder may have a composition represented by a formula, $R^3_{(1-p)}M^2_p$, in terms of the molar ratio (provided that $R^3$ is one or more elements selected from the group consisting of Nd and Pr; $M^2$ is a metal element other than rare earth elements, which is alloyed with $R^3$, and an unavoidable impurity element; and the following may be satisfied, $0.05 \leq p \leq 0.40$).

In the manufacturing method according to the second aspect, a diffusion and permeation temperature of the first modifying material may be lower than a diffusion and permeation temperature of the second modifying material or a diffusion and permeation temperature of the second modifying material powder.

In the manufacturing method according to the second aspect, the x may be $0.5 \leq x \leq 1.0$.

In the manufacturing method according to the second aspect, the $R^1$ may be one or more elements selected from the group consisting of Ce and La, the $R^2$ and the $R^3$ may be Nd, and the $R^4$ may be one or more elements selected from the group consisting of Tb and Nd.

According to the present disclosure, it is possible to provide a rare earth magnet having a further increased coercive force since the main phase includes a core portion in which a part of Nd's or the like are substituted with a light rare earth element, such as Ce, a first shell portion having a high content proportion of Nd or the like, and a second shell portion having a high existence proportion of a heavy rare earth element such as Tb. Further, according to the present disclosure, it is possible to provide a manufacturing method for the rare earth magnet having a further increased coercive force, by diffusing and permeating a heavy rare earth element into a rare earth magnet precursor in which a main phase includes a core portion in which a part of Nd's or the like are substituted with a light rare earth element, and a first shell portion having a high content proportion of Nd or the like.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Hereinafter, embodiments of the rare earth magnet and the manufacturing method therefor of the present disclosure will be described in detail. The embodiments described below do not limit the rare earth magnet and the manufacturing method therefor of the present disclosure.

For increasing the coercive force, it is effective to increase the anisotropic magnetic field of the main phase. In addition, for increasing the anisotropic magnetic field of the main phase, it is effective to incorporate a heavy rare earth element into the main phase. A method for incorporating a heavy rare earth element into the main phase will be described with reference to the drawings.

Figure 7A:
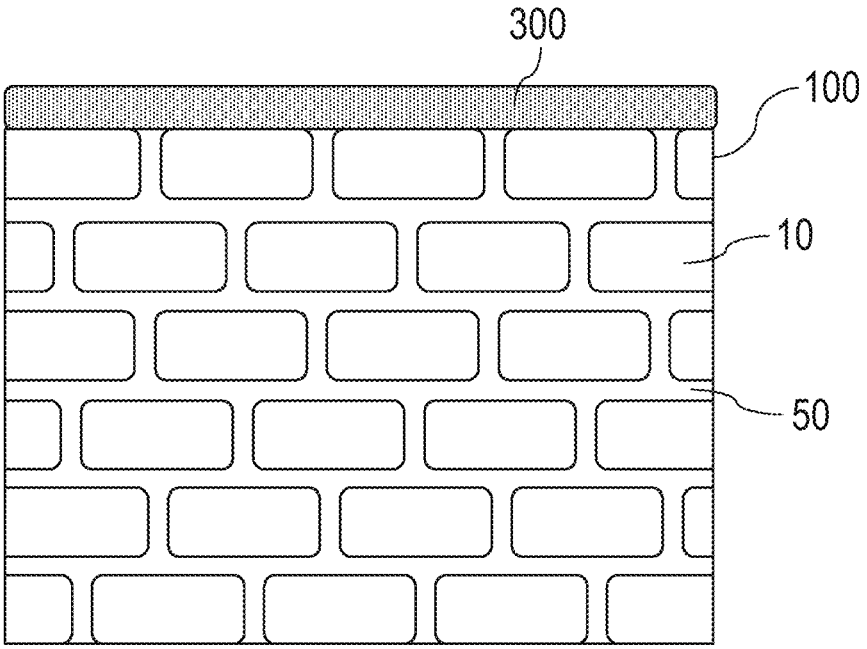
FIG. 7A is a cross-sectional illustrative view schematically illustrating a state in which a modifying material containing a heavy rare earth element is brought into contact with a rare earth magnet precursor in which a part of at least ones of Nd's or Pr's are substituted with a light rare earth element, and that includes a main phase which has no core/shell structure.
Figure 7B:
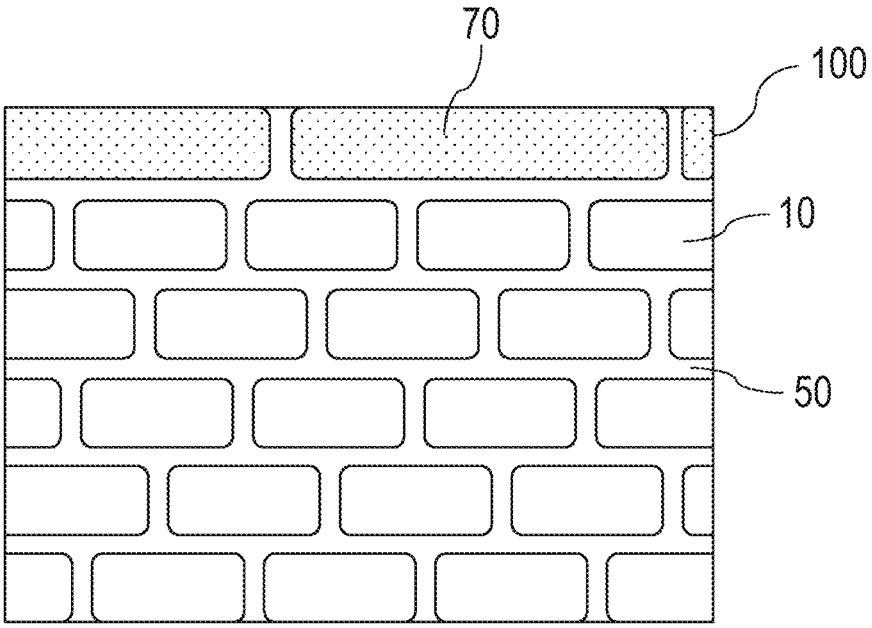
FIG. 7B is a cross-sectional illustrative view schematically illustrating a diffusion and permeation situation of the heavy rare earth element after heating in the state illustrated in FIG. 7A.

FIG. 7A is a cross-sectional illustrative view schematically illustrating a state in which a modifying material containing a heavy rare earth element is brought into contact with a rare earth magnet precursor in which a part of at least ones of Nd's or Pr's are substituted with a light rare earth element, and that includes a main phase which has no core/shell structure; and FIG. 7B is a cross-sectional illustrative view schematically illustrating a diffusion and permeation situation of the heavy rare earth element after heating in the state illustrated in FIG. 7A.

As illustrated in FIG. 7A, a non core/shell rare earth magnet precursor 100 is brought into contact with a heavy rare earth element modifying material 300. The non core/shell rare earth magnet precursor 100 is a rare earth magnet precursor in which a part of at least ones of Nd's or Pr's are substituted with a light rare earth element and that includes a main phase which has no core/shell structure. The heavy rare earth element modifying material 300 is a modifying material containing a heavy rare earth element. The non core/shell rare earth magnet precursor 100 includes a main phase 10 and a particle boundary phase 50.

When the non core/shell rare earth magnet precursor 100 and the heavy rare earth element modifying material 300 are heated in the state illustrated in FIG. 7A, the main phase 10 in the vicinity of the surface layer portion of the non core/shell rare earth magnet precursor 100 is changed to the coarsened main phase 70 as illustrated in FIG. 7B. Although not bound by theory, since in the non core/shell rare earth magnet precursor 100, a part of at least ones of Nd's or Pr's are substituted with a light rare earth element, the melting point of the main phase 10 is decreased. Accordingly, it is presumed that, during heating, the non core/shell rare earth magnet precursor 100 easily react with the heavy rare earth elements in the heavy rare earth element modifying material 300, and most of the heavy rare earth elements in the heavy rare earth element modifying material 300 are incorporated into the main phase 10 in the vicinity of the surface layer portion to form the coarsened main phase 70. As a result, it is presumed that the heavy rare earth elements in the heavy rare earth element modifying material 300 is not spread to the inside of the non core/shell rare earth magnet precursor 100, and the coercive force is not increased.

For example, in a case where the main phase 10 is $(Ce,La,Nd)_2Fe_{14}B$ and the heavy rare earth element modifying material 300 is a Tb—Ga-based alloy, the main phase 10 in the surface layer portion reacts with Tb to form $(Ce,La,Nd,Tb)_2Fe_{14}B$ as the coarsened main phase 70. As a result, Tb in the heavy rare earth element modifying material 300 is not spread to the inside of the non core/shell rare earth magnet precursor 100, and the coercive force is not increased.

In order for heavy rare earth element in the heavy rare earth element modifying material 300 to be spread to the inside of the non core/shell rare earth magnet precursor 100, the following may be performed, which is described with reference to the drawings.

Figure 1A:
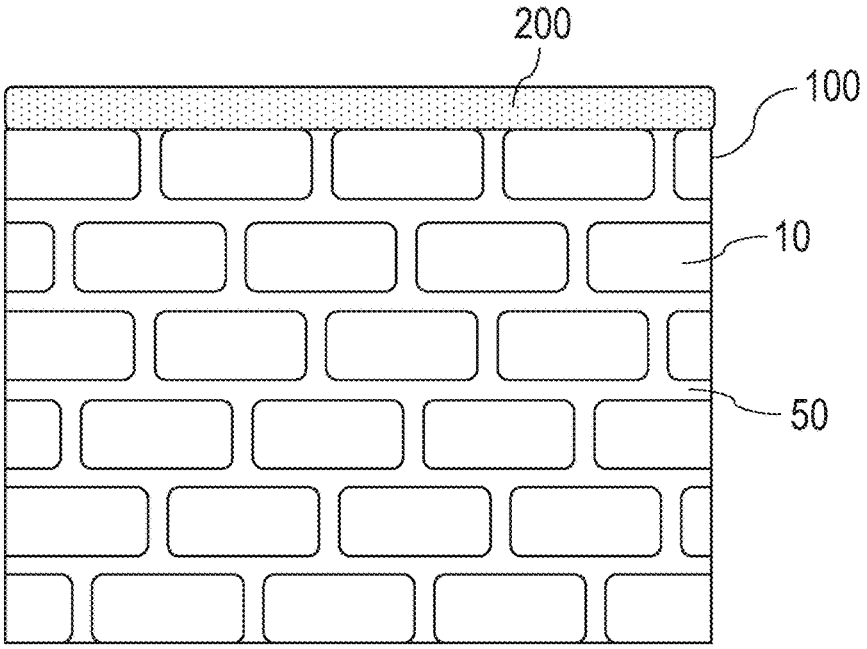
FIG. 1A is a cross-sectional illustrative view schematically illustrating a state in which a modifying material containing a medium rare earth element is brought into contact with a rare earth magnet precursor in which a part of at least ones of Nd's or Pr's are substituted with a light rare earth element, and that includes a main phase which has no core/shell structure.
Figure 1B:
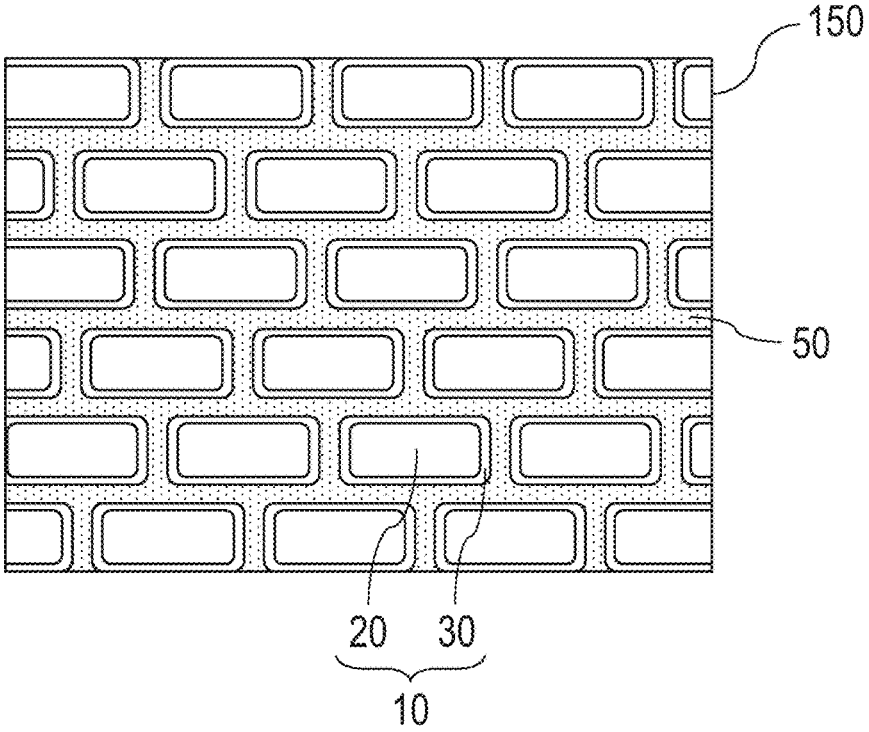
FIG. 1B is a cross-sectional illustrative view schematically illustrating a diffusion and permeation situation of the medium rare earth element after heating in the state illustrated in FIG. 1A.
Figure 1C:
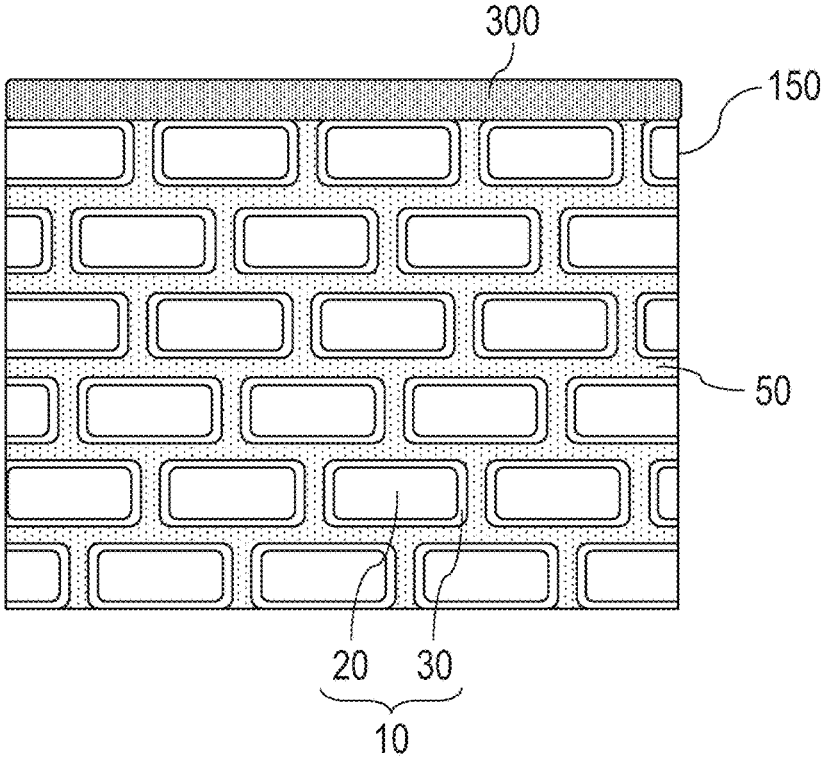
FIG. 1C is a cross-sectional illustrative view schematically illustrating a state in which a modifying material containing a heavy rare earth element is brought into contact with the rare earth magnet precursor illustrated in FIG. 1B.
Figure 1D:
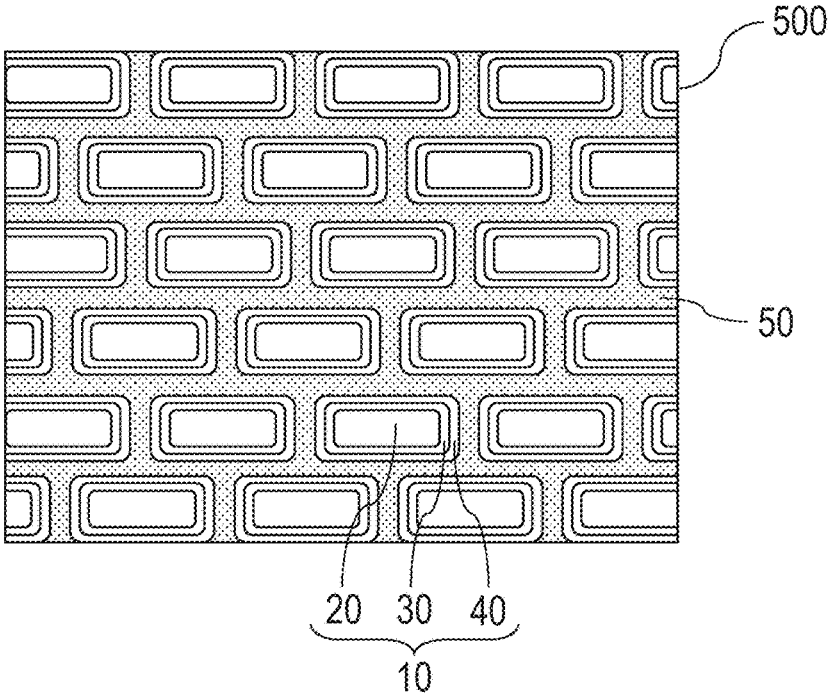
FIG. 1D is a cross-sectional illustrative view schematically illustrating a diffusion and permeation situation of the heavy rare earth element after heating in the state illustrated in FIG. 1C.

FIG. 1A is a cross-sectional illustrative view schematically illustrating a state in which a modifying material containing a medium rare earth element is brought into contact with a rare earth magnet precursor in which a part of at least ones of Nd's or Pr's are substituted with a light rare earth element, and which includes a main phase which has no core/shell structure. FIG. 1B is a cross-sectional illustrative view schematically illustrating a diffusion and permeation situation of the medium rare earth element after heating in the state illustrated in FIG. 1A. FIG. 1C is a cross-sectional illustrative view schematically illustrating a state in which a modifying material containing a heavy rare earth element is brought into contact with the rare earth magnet precursor illustrated in FIG. 1B. FIG. 1D is a cross-sectional illustrative view schematically illustrating a diffusion and permeation situation of the heavy rare earth element after heating in the state illustrated in FIG. 1C.

As illustrated in FIG. 1A, a non core/shell rare earth magnet precursor 100 is brought into contact with a medium rare earth element modifying material 200. The non core/shell rare earth magnet precursor 100 is a rare earth magnet precursor in which a part of at least ones of Nd's or Pr's are substituted with a light rare earth element and that includes a main phase which has no core/shell structure. The medium rare earth element modifying material 200 is a modifying material containing a medium rare earth element. The non core/shell rare earth magnet precursor 100 includes a main phase 10 and a particle boundary phase 50. The medium rare earth element means Nd and Pr.

When the non core/shell rare earth magnet precursor 100 and the medium rare earth element modifying material 200 are heated in the state illustrated in FIG. 1A, a melt of the medium rare earth element modifying material 200 is diffused and permeated through the particle boundary phase 50 as illustrated in FIG. 1B. Further, a part of the medium rare earth elements in the melt of the medium rare earth element modifying material 200 that have been diffused and permeated into the particle boundary phase 50 are substituted with a part of the light rare earth elements in the vicinity of the surface layer portion of the main phase 10, and a first shell portion 30 is formed. The first shell portion 30 is formed in the vicinity of the surface layer portion of the main phase 10, and the region of the main phase 10 other than the first shell portion 30 is formed as a core portion 20. The existence proportion of the medium rare earth element in the first shell portion 30 is higher than the existence proportion of the medium rare earth element in the core portion 20.

Although not bound by theory, the reason why the core portion 20 and the first shell portion 30 are formed in a case where the medium rare earth element modifying material is used, unlike a case where the heavy rare earth element modifying material is used, is presumed to be as follows. As described above, since in the non core/shell rare earth magnet precursor 100, a part of at least ones of Nd's or Pr's are substituted with a light rare earth element, the melting point of the main phase 10 is decreased. However, the reactivity of the medium rare earth element in the medium rare earth element modifying material 200 with the main phase 10 is lower than that of the heavy rare earth element in the heavy rare earth element modifying material 300. Therefore, a part of the medium rare earth elements in the medium rare earth element modifying material 200 are substituted with a part of the light rare earth elements in the vicinity of the surface layer portion of the main phase 10. As a result, the melt of the medium rare earth element modifying material is spread to the inside of the non core/shell rare earth magnet precursor 100, and the first shell portion is formed in the inside of the main phase 10 of the non core/shell rare earth magnet precursor 100.

Next, as illustrated in FIG. 1C, the heavy rare earth element modifying material 300 is brought into contact with a rare earth magnet precursor (hereinafter, may be referred to as a "core/shell rare earth magnet precursor 150") including a main phase 10 having a core portion 20 and a first shell portion 30, and heated. Then, as illustrated in FIG. 1D, the melt of the heavy rare earth element modifying material 300 is diffused and permeated through the particle boundary phase 50. Further, a part of the heavy rare earth elements in the melt of the heavy rare earth element modifying material 300 that have been diffused and permeated into the particle boundary phase 50 are substituted with a part of the light rare earth elements and a part of the medium rare earth elements in the first shell portion 30, and a second shell portion 40 is formed. The second shell portion 40 is formed in the vicinity of the surface layer portion of the first shell portion 30. The existence proportion of the medium rare earth element in the second shell portion 40 is lower than the existence proportion of the medium rare earth element in the first shell portion 30, and the second shell portion 40 contains a heavy rare earth element.

Although not bound by theory, the reason why the second shell portion 40 is formed is presumed to be as follows. As illustrated in FIG. 1C, the first shell portion 30 is in contact with the particle boundary phase 50 before the melt of the heavy rare earth element modifying material 300 is diffused and permeated. As described above, the existence proportion of the medium rare earth element in the first shell portion 30 is higher than the existence proportion of the medium rare earth element in the core portion 20. As a result, when the melt of the heavy rare earth element modifying material 300 that has diffused and permeated is diffused and permeated through the particle boundary phase 50, an excessive reaction with the first shell portion 30 does not occur. Further, a part of the light rare earth elements and a part of the medium rare earth elements in the vicinity of the surface layer portion of the first shell portion 30 are substituted with heavy rare earth elements in the melt of the heavy rare earth element modifying material 300.

In this manner, as illustrated in FIG. 1D, the second shell portion 40 containing a heavy rare earth element is formed up to the inside of the main phase 10 of a rare earth magnet 500 of the present disclosure. In a case where the main phase 10 contains a heavy rare earth element, the coercive force of the entire rare earth magnet 500 of the present disclosure is increased since the anisotropic magnetic field of the main phase 10 is increased. Further, as described in FIG. 1D, since the second shell portion 40 in which the heavy rare earth element is present is formed in the outermost portion of the main phase 10, the generation of the nucleus on the surface of the particle of the main phase 10 and the growth of the nucleus in the particle of an adjacent main phase 10 does not easily occur, which contributes to the increase in coercive force.

The constituent requirements of the rare earth magnet and the manufacturing method therefor according to the present disclosure will be described below.

Rare Earth Magnet

First, the constituent requirements of the rare earth magnet of the present disclosure will be described.

Figure 2:
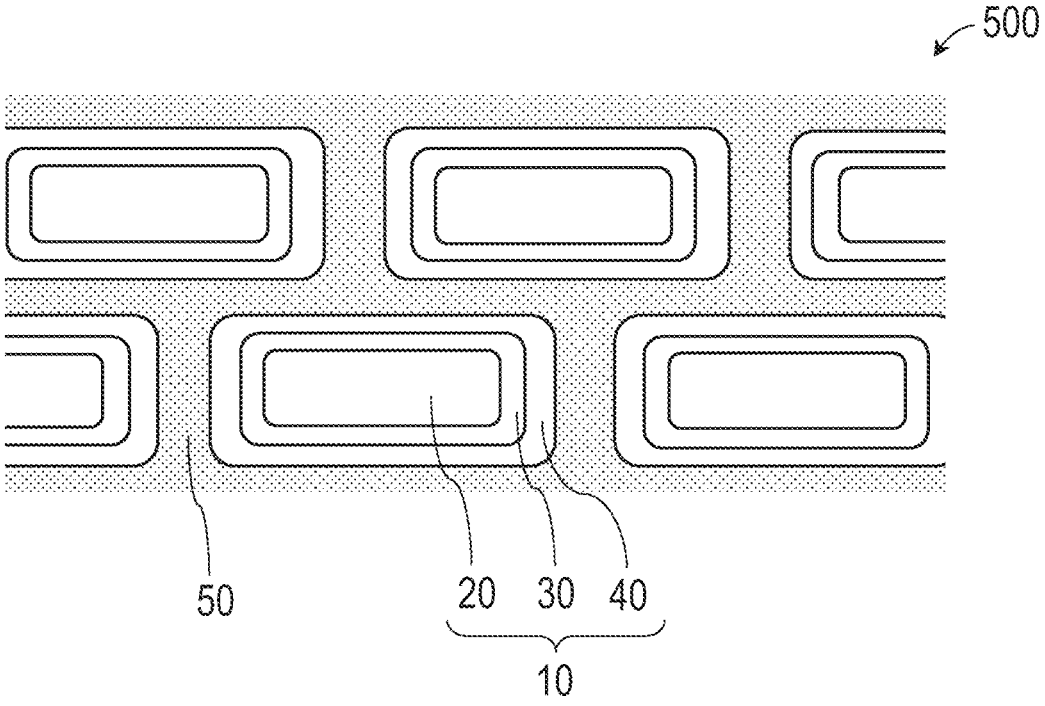
FIG. 2 is an illustrative view schematically illustrating a structure of a rare earth magnet of the present disclosure.

FIG. 2 is an illustrative view schematically illustrating a structure of a rare earth magnet of the present disclosure. As illustrated in FIG. 2, the rare earth magnet 500 of the present disclosure includes the main phase 10 and the particle boundary phase 50. The main phase 10 includes the core portion 20, the first shell portion 30, and the second shell portion 40. Hereinafter, the overall composition, the main phase 10, and the particle boundary phase 50 of the rare earth magnet 500 of the present disclosure are described. In addition, in regard to the main phase 10, the core portion 20, the first shell portion 30, and the second shell portion 40 are described.

Overall Composition

The overall composition of the rare earth magnet 500 of the present disclosure will be described. The overall composition of the rare earth magnet 500 of the present disclosure means a composition in which all of the main phases 10 and the particle boundary phases 50 are combined.

The overall composition of the rare earth magnet of the present disclosure is represented by a formula, $(R^2_{(1-x)}R^1_x)_y Fe_{(100-y-w-z-v)}Co_wB_zM^1_v(R^3_{(1-p)}M^2_p)_q (R^4_{(1-s)}M^3_s)_t$, in terms of the molar ratio. In this formula, $(R^2_{(1-x)}R^1_x)_y Fe_{(100-y-w-z-v)}Co_wB_zM^1_v (R^3_{(1-p)}M^2_p)_q$-represents a composition derived from the first rare earth magnet precursor. $(R^4_{(1-s)}M^3_s)_t$ represents a composition derived from the first modifying material.

The rare earth magnet of the present disclosure is obtained by diffusing and permeating the first modifying material having the composition represented by a formula, $(R^4_{(1-s)}M^3_s)_t$, into the inside of the first rare earth magnet precursor having the composition represented by the formula, $(R^2_{(1-x)}R^1_x)_yFe_{(100-y-w-z-v)}Co_wB_zM^1_v (R^3_{(1-p)}M^2_p)_q$. The first rare earth magnet precursor is one example of the rare earth magnet precursor (the core/shell rare earth magnet precursor 150) including the main phase 10 which has the core portion 20 and the first shell portion 30, which is illustrated in FIG. 1C. The first modifying material is one example of the modifying material (the heavy rare earth element modifying material 300) containing a heavy rare earth element, which is illustrated in FIG. 1C.

In the compositional formula, $(R^2_{(1-x)}R^1_x)_yFe_{(100-y-w-z-v)}Co_wB_zM^1_v. (R^3_{(1-p)}M^2_p)_q$. which is derived from the first rare earth magnet precursor, $(R^2_{(1-x)}R^1_x)_yFe_{(100-y-w-z-v)}Co_wB_zM^1_v$ is derived from the second rare earth magnet precursor, and $(R^3_{(1-p)}M^2_p)_q$. is derived from the second modifying material.

The first rare earth magnet precursor is obtained by diffusing and permeating the second modifying material having a composition represented by a formula, $(R^3_{(1-p)}M^2_p)_q$, into the inside of the second rare earth magnet precursor having a composition represented by a formula, $(R^2_{(1-x)}R^1_x)_yFe_{(100-y-w-z-v)}Co_wB_zM^1_v$. The second rare earth magnet precursor is one example of the non core/shell rare earth magnet precursor 100, which is illustrated in FIG. 1A. The second modifying material is one example of the medium rare earth element modifying material 200, which is illustrated in FIG. 1A.

In a case where the second modifying material of q parts by mole is diffused and permeated into the inside of the second rare earth magnet precursor of 100 parts by mole, a first rare earth magnet precursor of (100+q) parts by mole can be obtained. In a case where the first modifying material of t parts by mole is diffused and permeated into the inside of the first rare earth magnet precursor of (100+q) parts by mole, a rare earth magnet of (100+q+t) parts by mole of the present disclosure can be obtained.

In the formula representing the overall composition of the rare earth magnet of the present disclosure, the total of $R^1$ and $R^2$ is y parts by mole, Fe is (100-y-w-z-v) parts by mole, Co is w parts by mole, B is z parts by mole, and $M^1$ is v parts by mole, and thus the total thereof is, y parts by mole+(100-y-w-z-v) parts by mole+w parts by mole+z parts by mole+v parts by mole=100 parts by mole. The total of $R^3$ and $M^2$ is q parts by mole. The total of $R^4$ and $M^3$ is t parts by mole.

In $R^2_{(1-x)}R^1_x$ in the above formula, in terms of the molar ratio, $R^2$ of (1-x) is present, and R of x is present with respect to the total of $R^2$ and R. Similarly, in $R^3_{(1-p)}M^2_p$ in the above formula, in terms of the molar ratio, $R^3$ of (1-p) is present and $M^2$ of p is present with respect to the total of $R^3$ and $M^2$. Similarly, in $R^4_{(1-s)}M^3_s$ in the above formula, in terms of the molar ratio, $R^4$ of (1-s) is present, and $M^3$ of s is present with respect to the total of $R^4$ and $M^3$.

In the above formula, R is one or more elements selected from the group consisting of Ce, La, Y, and Sc. Ce is cerium, La is lanthanum, Y is yttrium, and Sc is scandium. $R^2$ and $R^3$ are one or more elements selected from the group consisting of Nd and Pr. Nd is neodymium, and Pr is praseodymium. $R^4$ is a rare earth element at least including one or more elements selected from the group consisting of Gd, Tb, Dy, and Ho, Gd is gadolinium, Tb is terbium, Dy dysprosium, and Ho is holmium. Fe is iron. Co is cobalt. B is boron. $M^1$ is one or more elements selected from the group consisting of Ga, Al, Cu, Au, Ag, Zn, In, and Mn, and an unavoidable impurity element. Ga is gallium, Al is aluminum, Cu is copper, Au is gold, Ag is silver, Zn is zinc, In is indium, and Mn is manganese. $M^2$ is a metal element other than the rare earth elements, which is alloyed with $R^3$, and an unavoidable impurity element. $M^3$ is a metal element other than the rare earth elements, which is alloyed with $R^4$, and an unavoidable impurity element.

In the present specification, unless otherwise specified, the rare earth elements are 17 elements of Sc, Y, La, Ce, Pr, Nd, Pm, Sm, Eu, Gd, Tb, Dy, Ho, Er, Tm, Yb, and Lu. Among these, Sc, Y, La, and Ce are light rare earth elements unless otherwise specified. Pr, Nd, Pm, Sm, and Eu are medium rare earth elements unless otherwise specified. Gd, Tb, Dy, Ho, Er, Tm, Yb, and Lu are heavy rare earth elements unless otherwise specified. In general, the rarity of heavy rare earth elements is high, and the rarity of light rare earth elements is low. The rarity of medium rare earth elements is between heavy rare earth elements and light rare earth elements.

The constituent elements of the rare earth magnet of the present disclosure, represented by the above formula, will be described below.

$R^1$ $R^1$ is the essential component for the rare earth magnet of the present disclosure. As described above, R is one or more elements selected from the group consisting of Ce, La, Y, and Sc, and belongs to the light rare earth element. R is a constituent element of the main phase ($R_2Fe_{14}B$ phase). In a case where at least a part of $R^1$ in the vicinity of the surface layer portion of the main phase is substituted with $R^3$ in the second modifying material, the main phase can have a core portion and a first shell portion. From the viewpoint of substitutability, $R^1$ is preferably one or more elements selected from the group consisting of Ce and La.

$R^2$

As described above, $R^2$ is one or more elements selected from the group consisting of Nd and Pr, and belongs to the medium rare earth element. $R^2$ is a constituent element of the main phase ($R_2Fe_{14}B$ phase). In regard to the rare earth magnet of the present disclosure, from the viewpoint of the balance between performance and price, it is preferable to increase the contents of Nd and Pr, and it is more preferable to increase the content of Nd. As $R^2$, in a case where Nd and Pr are caused to be present together, didymium may be used. From the viewpoint of performance, $R^2$ is preferably Nd.

Molar Ratio of $R^1$ and $R^2$

In the rare earth magnet of the present disclosure, $R^1$ and $R^2$ are elements derived from the second rare earth magnet precursor. In terms of the molar ratio, R of x is present, and $R^2$ of (1-x) is present with respect to the total of $R^1$ and $R^2$. Here, $0.1 \leq x \leq 1.0$ is satisfied.

As illustrated in FIG. 1A, the first shell portion 30 is formed by substituting $R^1$ present in the vicinity of the surface layer portion of the main phase 10 with $R^3$ of the second modifying material 200, and thus $R^1$ is essentially present even in a small amount. In a case where x is 0.1 or more, the formation of the first shell portion 30 can be substantially recognized. From the viewpoint of forming the first shell portion 30, x may be 0.2 or more, 0.3 or more, 0.4 or more, 0.5 or more, 0.6 or more, 0.7 or more, 0.8 or more, 0.9 or more, or 1.0. In a case where x is 1.0, it means that all of $R^1$ and $R^2$ are R (light rare earth element) in the total amount of R (light rare earth element) and $R^2$ (Nd and/or Pr).

In the $R_2Fe_{14}B$ phase (main phase), the anisotropic magnetic field (coercive force) and the residual magnetization are higher in a case where R contains more amount of rare earth elements other than light rare earth elements rather than containing light rare earth elements. In a case where the second modifying material is diffused and permeated into the second rare earth magnet precursor, in the vicinity of the surface layer portion of the main phase 10, a part of $R^1$ (light rare earth element) of the rare earth magnet precursor is substituted with $R^3$ (Nd and/or Pr) of the modifying material, and the first shell portion 30 is formed. As a result, the content proportion of Nd and/or Pr (rare earth element other than light rare earth elements) in the main phase 10 increases, which contributes to the increase in the anisotropic magnetic field (coercive force) and the residual magnetization.

In the main phase 10, the anisotropic magnetic field (coercive force) and the residual magnetic field of the entire rare earth magnet can be efficiently increased in a case where the anisotropic magnetic field (coercive force) and the residual magnetization of the outer peripheral portion are increased. From this point, it is favorable that $R^1$ (light rare earth element) is substituted with $R^3$ (Nd and/or Pr) in the first shell portion 30 in terms of improving the coercive force.

Total Content Proportion of $R^1$ and $R^2$

In the above formula, the total content proportion of $R^1$ and $R^2$ is represented by y and satisfies $12.0 \leq y \leq 20.0$. Here, the value of y is the content proportion to the second rare earth magnet precursor and corresponds to % by atom.

In a case where y is 12.0 or more, a large amount of αFe phase does not present in the second rare earth magnet precursor, and a sufficient amount of the main phase ($R_2Fe_{14}B$ phase) can be obtained. From this viewpoint, y may be 12.4 or more, 12.8 or more, or 13.2 or more. On the other hand, in a case where y is 20.0 or less, the amount of the particle boundary phase is not excessive. From this viewpoint, y may be 19.0 or less, 18.0 or less, or 17.0 or less.

B

As illustrated in FIG. 2, B constitutes the main phase 10 ($R_2Fe_{14}B$ phase) and affects the existence proportion of the main phase 10 and the particle boundary phase 50.

The content proportion of B is represented by z in the above formula. The value of y is the content proportion to the second rare earth magnet precursor and corresponds to % by atom. In a case where z is 20.0 or less, a rare earth magnet in which the main phase 10 and the particle boundary phase 50 are properly present can be obtained. From this viewpoint, z may be 18.0 or less, 16.0 or less, 14.0 or less, 12.0 or less, 10.0 or less, or 8.0 or less. On the other hand, in a case where z is 5.0 or more, a large amount of a phase having a $Th_2Zn_{17}$ type and/or $Th_2Ni_{17}$ type crystal structure is hardly generated, and as a result, the formation of the $R_2Fe_{14}B$ phase is not easily inhibited. From this viewpoint, z may be 5.8 or more, 6.0 or more, 6.2 or more, 6.4 or more, 6.6 or more, 6.8 or more, or 7.0 or more.

Co

Co is an element that can be substituted with Fe in the main phase and the particle boundary phase. In the present specification, in a case where Fe is described, this description means that a part of Fe's can be substituted with Co. For example, a part of Fe's in the $R_2Fe_{14}B$ phase are substituted with Co to become an $R_2(Fe,Co)_{14}B$ phase.

In a case where a part of Fe's are substituted with Co, thereby the $R_2Fe_{14}B$ phase becoming the $R_2(Fe,Co)_{14}B$ phase, the Curie point of the rare earth magnet of the present disclosure increases. In a case where the increase in the Curie point is not desired, Co may not be included, and the inclusion of Co is not essential.

In the above formula, the content proportion of Co is represented by w. The value of w is the content proportion to the second rare earth magnet precursor, and corresponds to % by atom. In a case where w is 0.5 or more, the increase in the Curie point is substantially recognized. From the viewpoint of increase in the Curie point, w may be 1.0 or more, 2.0 or more, 3.0 or more, or 4.0 or more. On the other hand, since Co is expensive, w may be 8.0 or less, 7.0 or less, or 6.0 or less from an economical viewpoint.

$M^1$ $M^1$ can be included within a range that does not impair the characteristics of the rare earth magnet of the present disclosure. $M^1$ may contain an unavoidable impurity element. In the present specification, the unavoidable impurity element refers to an impurity element the inclusion of which is unavoidable or an impurity element which causes a significant increase in manufacturing cost for avoiding the inclusion thereof, for example, an impurity element included in the raw material of the rare earth magnet, an impurity element mixed in the manufacturing process, or the like. The impurity element mixed in the manufacturing process or the like includes an element included within a range that does not affect the magnetic characteristics due to manufacturing reasons. In addition, the unavoidable impurity element includes a rare earth element other than the rare earth elements selected as $R^1$ and $R^2$, which is unavoidably mixed for the reasons described above.

Examples of the element that can be included within the range that does not impair the effects of the rare earth magnet and the manufacturing method for the rare earth magnet of the present disclosure include Ga, Al, Cu, Au, Ag, Zn, In, and Mn. As long as these elements are present below the upper limit of the $M^1$ content, these elements have substantially no effect on the magnetic characteristics. Therefore, these elements may be treated in the same manner as the unavoidable impurity element. In addition to these elements, $M^1$ may include an unavoidable impurity element.

In the above formula, the content proportion of $M^1$ is represented by v. The value of v is the content proportion to the second rare earth magnet precursor and corresponds to % by atom. In a case where the value of v is 2.0 or less, the magnetic characteristics of the rare earth magnet of the present disclosure are not impaired. From this viewpoint, v may be 1.5 or less, 1.0 or less, or 0.5 or less.

In regard to $M^1$, since Ga, Al, Cu, Au, Ag, Zn, In, and Mn and the unavoidable impurity element cannot be eliminated perfectly, there is no problem in practical use even in a case where the lower limit of v is 0.05, 0.1, or 0.2.

Fe

Fe is the remainder of $R^1$, $R^2$, Co, B, and $M^1$ described above, and the content proportion of Fe is represented by (100-y-w-z-v). In a case where y, w, z, and v are adjusted in the range described above, the main phase 10 and the particle boundary phase 50 are obtained as illustrated in FIG. 2.

$R^3$ $R^3$ is an element derived from the second modifying material. As illustrated in FIG. 1A, the second modifying material 200 is diffused and permeated into the inside of the second rare earth magnet precursor 100. A part of $R^1$ in the vicinity of the surface layer portion of the main phase 10 is substituted with $R^3$ of the second modifying material 200 to form the first shell portion 30.

$R^3$ is one or more elements selected from the group consisting of Nd and Pr, and belongs to the medium rare earth element. Among the medium rare earth elements, Nd and Pr easily form the $R_2Fe_{14}B$ phase. As described above, a part of the vicinity of the surface layer portion of $R^1$ (light rare earth element) of the main phase 10 is substituted with $R^3$ (Nd and/or Pr) of the second modifying material 200, and the existence proportion of Nd and/or Pr of the first shell portion 30 increases. As a result, as described above, in a case where the heavy rare earth element is diffused and permeated after the first shell portion 30 is formed, the heavy rare earth element can be spread to the inside of the rare earth magnet, which contributes to the increase in the coercive force. Further, the existence proportion of Nd and/or Pr is increased in the first shell portion 30 present in the outer peripheral portion of the main phase 10, which contributes to the increase in the anisotropic magnetic field (coercive force) and residual magnetization of the rare earth magnet of the present disclosure. From the viewpoint of the anisotropic magnetic field (coercive force), residual magnetization, and substitutability with $R^1$ (light rare earth element), $R^3$ is preferably Nd.

$M^2$ $M^2$ is a metal element other than the rare earth elements, which is alloyed with $R^3$, and an unavoidable impurity element. Typically, $M^2$ is an alloy element which decreases the melting point of $R^3_{(1-p)}M^2_p$ to a temperature lower than a melting point of $R^3$, and an unavoidable impurity element. Examples of $M^2$ include one or more elements selected from Cu, Al, Co, and Fe, and an unavoidable impurity element. $M^2$ is preferably one or more elements selected from Cu, Al, and Fe. From the viewpoint of lowering the melting point of $R^3_{(1-p)}M^2_p$, $M^2$ is particularly preferably Cu. The unavoidable impurity element refers to an impurity element the inclusion of which is unavoidable or an impurity element which causes a significant increase in manufacturing cost for avoiding the inclusion thereof, for example, an impurity element included in the raw material and an impurity element mixed in the manufacturing process, or the like. The impurity element mixed in the manufacturing process or the like includes an element included within a range that does not affect the magnetic characteristics due to manufacturing reasons. In addition, the unavoidable impurity element includes a rare earth element other than the rare earth elements selected as $R^3$, which is unavoidably mixed for the reasons described above.

Molar Ratio of $R^3$ to $M^2$ $R^3$ and $M^2$ form an alloy having a composition represented by a formula, $R^3_{(1-p)}M^2_p$, in terms of the molar ratio, and the second modifying material contains this alloy. Here, p satisfies $0.05 \leq p \leq 0.40$.

In a case where p is 0.05 or more, the melt of the second modifying material 200 can be diffused and permeated into the inside of the second rare earth magnet precursor 100 at the temperature at which the coarsening of the main phase 10 of the second rare earth magnet precursor 100 illustrated in FIG. 1A can be avoided. From this viewpoint, p is preferably 0.07 or more and more preferably 0.10 or more. On the other hand, in a case where p is 0.40 or less, the content of $M^2$ remaining in the particle boundary phase 50 of the rare earth magnet 500 of the present disclosure is reduced after the second modifying material 200 is diffused and permeated into the second rare earth magnet precursor 100, which contributes to the suppression of the decrease in residual magnetization. From this viewpoint, p may be 0.35 or less, 0.30 or less, 0.25 or less, 0.20 or less, or 0.15 or less.

$R^4$ $R^4$ is an element derived from the first modifying material. As illustrated in FIG. 1C and FIG. 1D, the melt of the first modifying material 300 is diffused and permeated into the inside of the first rare earth magnet precursor 150. A part of the light rare earth elements and a part of at least ones of Nd's or Pr's in the vicinity of the surface layer portion of the first shell portion 30 are substituted with $R^4$ of the first modifying material 300 to form the second shell portion 40.

$R^4$ is a rare earth element at least including one or more elements selected from the group consisting of Gd, Tb, Dy, and Ho. That is, $R^4$ is a rare earth element including one or more heavy rare earth elements selected from the group consisting of Gd, Tb, Dy, and Ho. As described above, a part of the light rare earth elements and a part of at least ones of Nd's or Pr's in the vicinity of the surface layer portion of the first shell portion 30 illustrated in FIG. 1C are substituted with the heavy rare earth elements of $R^4$ of the first modifying material 300, and the second shell portion 40 is formed. From the viewpoint of substitutability, $R^4$ is preferably Tb. As illustrated in FIG. 1D and FIG. 2, since the second shell portion 40 containing the heavy rare earth element is also formed in the inside of the main phase 10 of the rare earth magnet 500 of the present disclosure, the entire rare earth magnet 500 of the present disclosure has an increased coercive force. Further, as illustrated in FIG. 1D, since the second shell portion 40 in which the heavy rare earth element is present is formed in the outermost portion of the main phase 10, it is possible to suppress the generation of the inversely magnetized nucleus on the surface of the particle of the main phase 10 and the growth of the nucleus in the particle of an adjacent main phase 10, which is favorable for the increase in the coercive force.

$M^3$ $M^3$ is a metal element other than the rare earth elements, which is alloyed with $R^4$, and an unavoidable impurity element. Typically, $M^3$ is an alloy element which decreases the melting point of $R^4_{(1-s)}M^3_s$ to a temperature lower than a melting point of $R^4$, and an unavoidable impurity element. Examples of $M^3$ include one or more elements selected from Ga, Cu, Al, Co, and Fe, and an unavoidable impurity element. Since $R^4$ includes a heavy rare earth element and the heavy rare earth element has a high melting point, $M^3$ is preferably Ga and Cu from the viewpoint of lowering the melting point of $R^4_{(1-s)}M^3_s$. The unavoidable impurity element refers to an impurity element the inclusion of which is unavoidable or an impurity element which causes a significant increase in manufacturing cost for avoiding the inclusion thereof, for example, an impurity element included in the raw material and an impurity element mixed in the manufacturing process, or the like. The impurity element mixed in the manufacturing process or the like includes an element included within a range that does not affect the magnetic characteristics due to manufacturing reasons. In addition, the unavoidable impurity element includes a rare earth element other than the rare earth elements selected as $R^4$, which is unavoidably mixed for the reasons described above.

Molar Ratio of $R^4$ to $M^3$ $R^4$ and $M^3$ form an alloy having a composition represented by a formula, $R^4_{(1-s)}M^3_s$, in terms of the molar ratio, and the first modifying material contains this alloy. Here, s satisfies $0.05 \leq s \leq 0.40$.

In a case where s is 0.05 or more, the coarsening of the main phase 10 of the first rare earth magnet precursor 150, which is illustrated in FIG. 1C, can be avoided, and the melt of the first modifying material 300 can be diffused and permeated into the inside of the first rare earth magnet precursor 150 at the temperature at which the first shell portion 30 does not overreact with the first modifying material 300. From this viewpoint, s is preferably 0.07 or more, more preferably 0.09 or more, and still more preferably 0.12 or more. On the other hand, in a case where s is 0.40 or less, the content of $M^3$ remaining in the particle boundary phase 50 of the rare earth magnet 500 of the present disclosure is reduced after the first modifying material 300 is diffused and permeated into the first rare earth magnet precursor 150, which contributes to the suppression of the decrease in residual magnetization. From this viewpoint, s may be 0.35 or less, 0.30 or less, 0.25 or less, 0.20 or less, or 0.15 or less.

Molar Ratio of Element Derived from Rare Earth Magnet Precursor to Element Derived from Modifying Material In the above formula, the proportion of the second modifying material to 100 parts by mole of the second rare earth magnet precursor is q parts by mole. In addition, the proportion of the first modifying material to 100 parts by mole of the second rare earth magnet precursor is t parts by mole. That is, in a case where the second modifying material of q parts by mole is diffused and permeated into the second rare earth magnet precursor of 100 parts by mole, a first rare earth magnet precursor of (100+q) parts by mole is obtained. In a case where the first modifying material of t parts by mole is diffused and permeated into the first rare earth magnet precursor of 100 parts by mole+q parts by mole, a rare earth magnet of 100 parts by mole+q parts by mole+t parts by mole of the present disclosure is obtained. Accordingly, q is the molar ratio of the content of the element derived from the second modifying material in a case where the total content of the elements derived from the second rare earth magnet precursor is set to 100. t is the molar ratio of the content of the element derived from the first modifying material in a case where the total content of the elements derived from the second rare earth magnet precursor is set to 100. In other words, the rare earth magnet of the present disclosure has a content of (100+q+t) % by atom with respect to the second rare earth magnet precursor of 100% by atom.

In a case where q is 0.1 or more, at least a part of $R^1$ (light rare earth element) of the main phase 10 of the second rare earth magnet precursor 100 can be substituted with $R^3$ (Nd and/or Pr) of the second modifying material 200, and the first shell portion 30 can be formed. In a case where the heavy rare earth element is diffused and permeated after the formation of the first shell portion 30, the heavy rare earth element can be spread into the inside of the rare earth magnet 500 of the present disclosure. Further, since the existence proportion of Nd and/or Pr is increased in the outer peripheral portion of the main phase 10, the anisotropic magnetic field (coercive force) and residual magnetization of the rare earth magnet 500 of the present disclosure can be increased. From these viewpoints, q may be 0.5 or more, 1.0 or more, 1.5 or more, 2.0 or more, 2.5 or more, 3.0 or more, 3.5 or more, 4.0 or more, 4.5 or more, 4.7 or more, 5.0 or more, or 5.5 or more. On the other hand, in a case where q is 15.0 or less, the content of $M^2$ remaining in the particle boundary phase 50 of the rare earth magnet 500 of the present disclosure is reduced, which contributes to the increase in the residual magnetization. From this viewpoint, q is 14.0 or less, 13.0 or less, 12.0 or less, 11.0 or less, 10.4 or less, 10.0 or less, 9.5 or less, 9.0 or less, 8.5 or less, 8.0 or less, 7.5 or less, 7.0 or less, or 6.5 or less.

In a case where t is 0.1 or more, the second shell portion 40 containing a heavy rare earth element is formed in the main phase 10 such that the anisotropic magnetic field of the main phase 10 is increased, and as a result, the coercive force can be increased. From this viewpoint, t may be 0.2 or more, 0.4 or more, 0.6 or more, 0.8 or more, 1.0 or more, 1.2 or more, 1.4 or more, 1.5 or more, or 2.0 or more. On the other hand, the effect of increasing the anisotropic magnetic field by the heavy rare earth element can be obtained even with a relatively small amount of the heavy rare earth element. It is noted the rarity of the heavy rare earth element is high. From these viewpoints, t may be 5.0 or less, 4.5 or less, 4.0 or less, 3.5 or less, 3.0 or less, or 2.5 or less.

As illustrated in FIG. 2, the rare earth magnet 500 of the present disclosure includes the main phase 10 and the particle boundary phase 50. The main phase 10 includes the core portion 20, the first shell portion 30, and the second shell portion 40. Hereinafter, the main phase 10 and the particle boundary phase 50 will be described. In addition, in regard to the main phase 10, the core portion 20, the first shell portion 30, and the second shell portion 40 are described.

Main Phase

The main phase has a crystal structure of an $R_2Fe_{14}B$ type. R is a rare earth element. The reason why the description of the $R_2Fe_{14}B$ "type" is used is that an element other than R, Fe, and B can be included in the main phase (in the crystal structure) in at least one of a substitution type or an intrusion type. For example, in the main phase, a part of Fe's may be substituted with Co. Alternatively, for example, in the main phase, a part of any elements of R, Fe, and B may be substituted by $M^1$. Alternatively, for example, $M^1$ may be present in the main phase as an intrusion type.

The effects of the present disclosure, particularly the effect of forming the first shell portion and the second shell portion in the main phase to increase the coercive force is obtained by, for example, a sintered magnet including the main phase 10 having a particle size in a micrometer level, or for example, a hot-plastically processed magnet having a nano crystallized main phase.

The average particle size of the main phase is 0.1 μm to 20 m. In a case where the average particle size of the main phase is 0.1 μm or more, the effect of forming the first shell portion and the second shell portion can be substantially recognized. From this viewpoint, the average particle size of the main phase may be 0.2 μm or more, 0.4 m or more, 0.6 μm or more, 0.8 μm or more, 1.0 μm or more, 2.0 μm or more, 3.0 μm or more, 4.0 μm or more, 5.0 μm or more, 6.0 μm or more, 7.0 μm or more, 8.0 μm or more, or 9.0 μm or more. On the other hand, in a case where the average particle size of the main phase is 20 μm or less, the increase in the coercive force due to the formation of the first shell portion and the second shell portion is larger than the decrease in the coercive force due to the increase in the size of the main phase. From this viewpoint, the average particle size of the main phase may be 18 μm or less, 16 μm or less, 14 μm or less, 12 μm or less, 10 μm or less, 9 μm or less, 8 μm or less, 7 μm or less, 6 μm or less, 5 μm or less, or 4 μm or less.

The "average particle size" is measured as follows. In a scanning electron microscope image or a transmission electron microscope image, a certain region observed in the direction perpendicular to the easy-magnetization axis is defined, and a plurality of lines are drawn in the direction perpendicular to the easy-magnetization axis with respect to the main phase present in this certain region, and the size (length) of the main phase is calculated from the distance between the points intersecting in the particle of the main phase (cutting method). In a case where the cross section of the main phase is close to a circle, the distance is converted to the equivalent projected area circle diameter. In a case where the cross section of the main phase is close to a rectangle, the distance is converted by a rectangular parallelepiped approximation. The distribution (particle size distribution) of the values of $D_{50}$ of the sizes (lengths) obtained in this manner is the average particle size. As illustrated in FIG. 2, since the main phase 10 of the rare earth magnet 500 of the present disclosure has the core portion 20, the first shell portion 30, and the second shell portion 40, the length of the size of the main phase 10 is a size (length) including the first shell portion 30 and the second shell portion 40.

Core Portion

As illustrated in FIG. 2, the core portion 20 is present in the main phase 10 and is surrounded by the first shell portion 30 and the second shell portion 40.

The first modifying material and the second modifying material are not diffused and permeated into the core portion. Therefore, the composition and crystal structure of the core portion are respectively the same as the composition and crystal structure of the main phase 10 of the second rare earth magnet precursor 100 illustrated in FIG. 1A.

First Shell Portion

As illustrated in FIG. 2, the first shell portion 30 is present around the core portion 20. In addition, the second shell portion 40 is present around the first shell portion 30. That is, the first shell portion 30 is present between the core portion 20 and the second shell portion 40. The composition and crystal structure of the first shell portion will be described later.

The first shell portion 30 is formed by diffusing and permeating the second modifying material 200 into the second rare earth magnet precursor 100 (see FIG. 1A and FIG. 1B), and further diffusing and permeating the first modifying material 300 (see FIG. 1C and FIG. 1D).

Due to the diffusion and permeation of the second modifying material 200, a part of the light rare earth elements present in the vicinity of the surface layer portion of the main phase 10 is discharged to the particle boundary phase 50. Then, a part of at least ones of Nd's or Pr's in the melt of the second modifying material 200 that has diffused and permeated through the particle boundary phase 50 is incorporated in the vicinity of the surface layer portion of the main phase 10, and the first shell portion 30 is formed. The portion where the second modifying material 200 has not been diffused and permeated and thus the first shell portion 30 has not been formed remains as the core portion 20. Further, due to the diffusion and permeation of the first modifying material 300, a part of the light rare earth elements and a part of at least ones of Nd's or Pr's present in the vicinity of the surface layer of the first shell portion 30 are discharged to the particle boundary phase 50, a part of the heavy rare earth elements in the melt of the first modifying material 300 that has diffused and permeated through the phase 50 is incorporated in the vicinity of the surface layer portion of the first shell portion 30, and the second shell portion 40 is formed. Since the first shell portion 30 is formed by such substitution, the $R_2Fe_{14}B$ type is maintained in the crystal structure of the first shell portion 30. For this reason, after the diffusion and permeation of the second modifying material 200 and the first modifying material 300, the existence proportion of Nd and/or Pr is higher in the first shell portion 30 than in the core portion 20. That is, the total of molar ratios of Nd and Pr in the first shell portion 30 is higher than a total of molar ratios of Nd and Pr in the core portion 20.

In a case where the total of molar ratios of Nd and Pr in the first shell portion 30 is at least 1.2 times the total of molar ratios of Nd and Pr in the core portion, the distinction between the core portion 20 and the first shell portion 30 can be substantially distinguished. Further, when the heavy rare earth element is diffused and permeated by the first modifying material 300, Nd and/or Pr is substituted with Pr and a heavy rare earth element in the vicinity of the surface layer portion of the first shell portion 30, and thus the second shell portion 40 can be formed. From this viewpoint, the total of molar ratios of Nd and Pr in the first shell portion 30 may be equal to or more than the total of molar ratios of Nd and Pr in the core portion by 1.4 times, 1.6 times, or 1.8 times. On the other hand, in a case where the total of molar ratios of Nd and Pr in the first shell portion 30 is equal to or less than the total of molar ratios of Nd and Pr in the core portion by 3.0 times, the diffusion and permeation of an extra first modifying material 300, exceeding the demanded amount, can be avoided. From such a viewpoint, the total of molar ratios of Nd and Pr in the first shell portion 30 may be equal to or less than the total of molar ratios of Nd and Pr in the core portion by 2.8 times, 2.6 times, 2.4 times, 2.2 times, or 2.0 times.

The compositions of the core portion 20 and the first shell portion 30 is determined based on the results from component analysis obtained by an energy dispersive X-ray spectroscopic analyzer (Cs-STEM-EDX: Corrector-Spherical Aberration-Scanning Transmission Electron Microscope-Energy Dispersive X-ray Spectrometry) of the scanning transmission electron microscope having a spherical aberration correction function. Cs-STEM-EDX is used because it is not easy to separately observe the core portion 20 and the first shell portion 30 with an energy dispersive X-ray spectroscopic analyzer (SEM-EDX: Scanning Electron Microscope-Energy Dispersive X-ray Spectrometry) of the scanning electron microscope.

The thickness of the first shell portion may be appropriately determined in relation to the composition of the first shell portion and the like and is not particularly limited. The thickness of the first shell portion may be, for example, 30 nm or more, 50 nm or more, 100 nm or more, 150 nm or more, 200 nm or more, 250 nm or more, 300 nm or more, 350 nm or more, or 400 nm or more, and may be 1,000 nm or less, 900 nm or less, 800 nm or less, 700 nm or less, 600 nm or less, or 500 nm or less.

The thickness of the first shell portion means the separation distance between the outer periphery of the core portion and the outer periphery of the first shell portion. In the measuring method for the thickness of the first shell portion, a certain region is defined, the separation distance of each of the main phases present in this certain region is measured using a scanning electron microscope or a transmission electron microscope, and each separation distance is determined by averaging the measured separation distances.

Second Shell Portion

As illustrated in FIG. 2, the second shell portion 40 is present around the first shell portion 30.

The second shell portion 40 is formed by diffusing and permeating the first modifying material 300 into the first rare earth magnet precursor 150 in which the first shell portion 30 has been formed (see FIG. 1C and FIG. 1D). When the first modifying material 300 is diffused and permeated, a part of the light rare earth elements and a part of at least ones of Nd's or Pr's present in the vicinity of the surface layer of the first shell portion 30 are discharged to the particle boundary phase 50. Then, a part of heavy rare earth elements in the melt of the first modifying material 300 that has diffused and permeated through the particle boundary phase 50 is incorporated in the vicinity of the surface layer portion of the first shell portion 30, and the second shell portion 40 is formed. Since the second shell portion 40 is formed by such substitution, the $R_2Fe_{14}B$ type is maintained in the crystal structure of the second shell portion 40. As a result, the existence proportion of Nd and/or Pr is lower in the second shell portion 40 than in the first shell portion 30. That is, the total of molar ratios of Nd and Pr in the second shell portion 40 is lower than the total of molar ratios of Nd and Pr in the first shell portion 30. The second shell portion 40 contains a heavy rare earth element, that is, one or more elements selected from the group consisting of Gd, Tb, Dy, and Ho. The total content proportion of one or more elements selected from the group consisting of Gd, Tb, Dy, and Ho may be, in terms of the molar ratio, 0.15 or more, 0.20 or more, 0.22 or more, or 0.25 or more, and 0.45 or less, 0.40 or less, 0.34 or less, 0.32 or less, or 0.30 or less, with respect to the entire second shell portion 40.

The core portion 20 and the first shell portion 30 substantially contain almost no Gd, Tb, Dy, and Ho, except for a case of being unavoidably mixed from raw materials or the like. Accordingly, the total of molar ratios of Gd, Tb, Dy, and Ho in the second shell portion 40 is higher than the total of molar ratios of Gd, Tb, Dy, and Ho in the core portion 20. In addition, the total of molar ratios of Gd, Tb, Dy, and Ho in the second shell portion 40 is higher than the total of molar ratios of Gd, Tb, Dy, and Ho in the first shell portion 30. Accordingly, the total of molar ratios of Gd, Tb, Dy, and Ho in the second shell portion 40 is equal to or more than the total of molar ratios of Gd, Tb, Dy, and Ho in the core portion 20 by 2.0 times. In addition, the total of molar ratios of Gd, Tb, Dy, and Ho in the second shell portion is at least 2.0 times the total of molar ratios of Gd, Tb, Dy, and Ho in the first shell portion. The upper limit of times of the above-described total of molar ratios is not set because, as described above, the core portion 20 and the first shell portion 30 substantially contain almost no Gd, Tb, Dy, and Ho, except for a case of being unavoidably mixed from raw materials or the like and thus the times are infinitely high.

In a case where the diffusion and permeation amount of the first modifying material 300 is large, the total of molar ratios of Gd, Tb, Dy, and Ho in the particle boundary phase 50 is higher than the total of molar ratios of Gd, Tb, Dy, and Ho in the second shell portion 40. However, even in a case where Gd, Tb, Dy, and Ho are high in the particle boundary phase 50, the contribution to the increase in the anisotropic magnetic field and the residual magnetization is small. In addition, since Gd, Tb, Dy, and Ho belong to heavy rare earth elements and are highly rare, it is preferable to minimize the diffusion and permeation amount of the first modifying material 300. Accordingly, it is preferable that the total of molar ratios of Gd, Tb, Dy, and Ho in the second shell portion 40 is higher than the total of molar ratios of Gd, Tb, Dy, and Ho in the particle boundary phase 50. The total of molar ratios of Gd, Tb, Dy, and Ho in the second shell portion 40 may be equal to or more than the total of molar ratios of Gd, Tb, Dy, and Ho in the particle boundary phase 50 by 1.5 times, 2.0 times, 2.2 times, 2.5 times, 3.0 times, 3.5 times, or 4.0 times, or equal to or less than that by 8.0 times, 6.0 times, or 5.0 times.

In a case where the total of molar ratios of Nd and Pr in the second shell portion 40 is equal to or more than the total of molar ratios of Nd and Pr in the first shell portion 30 by 0.5 times, the entire region of the first shell portion 30 is not substituted with a heavy rare earth element while the first modifying material 300 are diffused and permeated. In a case where the entire region of the first shell portion 30 is substituted with a heavy rare earth element, merely the first shell portion 30 in the vicinity of the surface layer portion (contact surface with the first modifying material 300) of the first rare earth magnet precursor 150 is substituted with a heavy rare earth element. As a result, the heavy rare earth element is spread to the inside of the rare earth magnet after the diffusion and permeation of the first modifying material 300, which hinders the increase in the coercive force of the entire rare earth magnet. From this viewpoint, the total of molar ratios of Nd and Pr in the second shell portion 40 may be equal to or more than the total of molar ratios of Nd and Pr in the first shell portion 30 by 0.6 times or 0.7 times.

On the other hand, in a case where the total of molar ratios of Nd and Pr in the second shell portion 40 is equal to or less the total of molar ratios of Nd and Pr in the first shell portion 30 by 0.9 times, the second shell portion 40 can be formed by appropriately substituting Nd and/or Pr of the first shell portion 30 with a heavy rare earth element. From this viewpoint, the total of molar ratios of Nd and Pr in the second shell portion 40 may be equal to or less the total of molar ratios of Nd and Pr in the first shell portion 30 by 0.8 times.

The compositions of the first shell portion 30 and the second shell portion 40 is determined based on the results from component analysis obtained by an energy dispersive X-ray spectroscopic analyzer (Cs-STEM-EDX: Corrector-Spherical Aberration-Scanning Transmission Electron Microscope-Energy Dispersive X-ray Spectrometry) of the scanning transmission electron microscope having a spherical aberration correction function. Cs-STEM-EDX is used because it is not easy to separately observe the first shell portion 30 and the second shell portion 40 with an energy dispersive X-ray spectroscopic analyzer (SEM-EDX: Scanning Electron Microscope-Energy Dispersive X-ray Spectrometry) of the scanning electron microscope.

The thickness of the second shell portion may be appropriately determined in relation to the composition of the second shell portion and the like and is not particularly limited. The thickness of the second shell portion may be, for example, 30 nm or more, 50 nm or more, 100 nm or more, 150 nm or more, 200 nm or more, 250 nm or more, or 300 nm or more, and may be 800 nm or less, 700 nm or less, 600 nm or less, or 500 nm or less.

The thickness of the second shell portion means the separation distance between the outer periphery of the first shell portion and the outer periphery of the second shell portion. In the measuring method for the thickness of the second shell portion, a certain region is defined, the separation distance of each of the main phases present in this certain region is measured using a scanning electron microscope or a transmission electron microscope, and each separation distance is determined by averaging the measured separation distances.

Particle Boundary Phase

As illustrated in FIG. 2, the rare earth magnet 500 of the present disclosure includes the main phase 10 and the particle boundary phase 50 present around the main phase 10. As described above, the main phase 10 includes a magnetic phase ($R_2Fe_{14}B$ phase) having the crystal structure of an $R_2Fe_{14}B$ type. On the other hand, the particle boundary phase 50 includes a phase of which the crystal structure is unclear as well as a phase having a crystal structure other than the $R_2Fe_{14}B$ type. Although not bound by theory, the "phase of which the structure is unclear" means a phase (state) in which at least a part of the phase has incomplete crystal structures, which are present irregularly. Alternatively, it means that at least a part of such a phase (state) is a phase that hardly exhibits a crystal structural aspect, such as an amorphous phase.

Although the particle boundary phase 50 is unclear in the crystal structure, the composition of the particle boundary phase 50 has a higher content proportion of R than the main phase 10 ($R_2Fe_{14}B$ phase). For this reason, the particle boundary phase 50 may be referred to as an "R-rich phase", a "rare earth element-rich phase", or a "rare earth-rich phase".

The particle boundary phase 50 may have an $R_{1.1}Fe_4B_4$ phase as a triple point. The triple point corresponds to the final solidified portion at the time of manufacturing the second rare earth magnet precursor 100. The $R_{1.1}Fe_4B_4$ phase hardly contributes to the anisotropic magnetic field (coercive force) and residual magnetization of the rare earth magnet 500 of the present disclosure. Therefore, it is preferable to cause Fe to be included in the first modifying material 300 and/or the second modifying material 200 and to cause the $R_{1.1}Fe_4B_4$ phase to be changed to an $R_2Fe_{14}B$ phase, thereby allowing the $R_2Fe_{14}B$ phase to be present as a part of the main phase 10.

Manufacturing Method

Nest, a manufacturing method for a rare earth magnet of the present disclosure will be described.

The manufacturing method for a rare earth magnet of the present disclosure includes a first rare earth magnet precursor preparation process, a first modifying material preparation process, and a first modifying material diffusion and permeation process. The following two aspects can be considered as a manufacturing method for a first rare earth magnet precursor. The first aspect is a manufacturing method including a second rare earth magnet precursor preparation process, a second modifying material preparation process, and a second modifying material diffusion and permeation process. The second aspect is a manufacturing method including a second rare earth magnet precursor powder preparation process, a second modifying material powder preparation process, and a mixing and sintering process. Hereinafter, each of the first rare earth magnet precursor preparation process, the first modifying material preparation process, and the first modifying material diffusion and permeation process will be described, and then the two aspects of the manufacturing method for the first rare earth magnet precursor will be described. For some matters of the first aspect, WO 2014/196605 can be referred to. The so-called "dual alloy method" is applied to the second aspect.

Preparation of First Rare Earth Magnet Precursor

As illustrated in FIG. 1B, the first rare earth magnet precursor 150 in which the overall composition is represented by a formula, $(R^2_{(1-x)}R^1_x)_yFe_{(100-y-w-z-y-v)}Co_wB_zM^1_v(R^3_{(1-p)}M^2_p)_q$, in terms of the molar ratio, is prepared. In the formula representing the overall composition of the first rare earth magnet precursor 150, $R^1$, $R^2$, $R^3$, Fe, Co, B, $M^1$, and $M^2$ and x, y, z, w, v, p, and q are as described in "<<Rare earth magnet >>".

As illustrated in FIG. 1B, the first rare earth magnet precursor 150 includes the main phase 10 and the particle boundary phase 50 present around the main phase 10. In addition, the main phase 10 includes the core portion 20 and the first shell portion 30 present around the core portion 20. The composition and crystal structure of the main phase 10, the core portion 20, and the first shell portion 30 are as described in "<<Rare earth magnet >>".

In the manufacturing method for a rare earth magnet of the present disclosure (hereinafter, may be referred to as "the manufacturing method of the present disclosure"), the first modifying material 300 is diffused and permeated into the first rare earth magnet precursor 150 to form the second shell portion 40 at a temperature at which the main phase 10 of the first rare earth magnet precursor 150 is not coarsened. As a result, the average particle size of the main phase 10 of the first rare earth magnet precursor 150 and the average particle size of the main phase 10 of the rare earth magnet 500 of the present disclosure are substantially in the same range. The average particle size of the main phase 10 of the first rare earth magnet precursor 150 and the composition and crystal structure of the second shell portion 40 are as described in "<<Rare earth magnet >>".

Preparation of First Modifying Material

As illustrated in FIG. 1C, the first modifying material 300 having a composition represented by a formula, $R^4_{(1-s)}M^3_s$, in terms of the molar ratio, is prepared. In the formula representing the composition of the first modifying material 300, $R^4$, $M^3$, and s are as described in "<<Rare earth magnet >>".

Examples of the preparing method for the first modifying material 300 include a method of obtaining a thin ribbon or the like from a molten metal having the composition of the first modifying material 300 by using a liquid quenching method, a strip casting method, or the like. In this method, since the molten metal is rapidly cooled, segregation hardly occurs in the first modifying material 300. Other examples of the preparing method for the first modifying material 300 include casting a molten metal having a composition of a modifying material into a mold such as a book mold. With this method, a large amount of the first modifying material 300 can be obtained relatively easily. In order to reduce the segregation of the first modifying material 300, the book mold is preferably made of a material having high thermal conductivity. In addition, it is preferable that the cast material is subjected to an uniformization heat treatment to suppress segregation. Other examples of the preparing method for the first modifying material 300 includes a method of obtaining an ingot by charging a raw material of the first modifying material 300 into a container, arc-melting the raw material in the container, and then cooling the molten material. With this method, the first modifying material can be obtained relatively easily even in a case where the melting point of the raw material is high. From the viewpoint of reducing segregation of the first modifying material, it is preferable that the ingot is subjected to an uniformization heat treatment.

Diffusion and Permeation of First Modifying Material

As illustrated in FIG. 1C, the first modifying material 300 is brought into contact with the first rare earth magnet precursor 150, thereby both being heated. The diffusion and permeation temperature is not particularly limited as long as it is a temperature at which the first modifying material 300 can be diffused and permeated into the first rare earth magnet precursor 150. The temperature at which the first modifying material 300 can be diffused and permeated means a temperature at which the main phase 10 (core portion 20 and first shell portion 30) is not damaged and the second shell portion 40 can be formed.

The diffusion and permeation temperature of the first modifying material is typically 750° C. or higher, 775° C. or higher, or 800° C. or higher, or 1,000° C. or lower, 950° C. or lower, 925° C. or lower, or 900° C. or lower, in a case where the size of the main phase of the first rare earth magnet precursor is in the micrometer level. The micrometer level means that the average particle size of the main phase is 1 to 20 km.

The diffusion and permeation temperature of the first modifying material is typically 600° C. or higher, 650° C. or higher, or 675° C. or higher, or 750° C. or lower, 725° C. or lower, or 700° C. or lower, in a case where the main phase of the first rare earth magnet precursor is nano crystallized. "nano crystallized" means that the average particle size of the main phase is 0.1 to 1.0 μm and particularly 0.1 to 0.9 m.

As illustrated in FIG. 1C, the first shell portion 30 is formed in the main phase 10 of the first rare earth magnet precursor 150. Further, as illustrated in FIG. 1A and FIG. 1B, the second modifying material 200 is diffused and permeated into the second rare earth magnet precursor 100 to form the first shell portion 30. As illustrated in FIGS. 1C and 1D, in a case where the first modifying material 300 is diffused and permeated into the inside of the first rare earth magnet precursor 150 to form the second shell portion 40, the first shell portion 30 is further diffused and permeated at a temperature at which damage does not occur, within the above-described temperature range for avoiding the coarsening of the main phase 10. For that purpose, it is preferable that the diffusion and permeation temperature of the first modifying material 300 is lower than the diffusion and permeation temperature of the second modifying material 200. Specifically, in a case where the diffusion and permeation temperature of the second modifying material 200 is denoted by Ma° C. and the diffusion and permeation temperature of the first modifying material is denoted by Mb°

C., Ma-Mb may be 10° C. or higher, 20° C. or higher, 25° C. or higher, 40° C. or higher, or 50° C. or higher, and is preferably 200° C. or lower, 180° C. or lower, 160° C. or lower, 150° C. or lower, 120° C. or lower, or 100° C. or lower.

At the time of diffusion and permeation of the first modifying material 300, the first modifying material 300 of t parts by mole is brought into contact with the first rare earth magnet precursor 150 with respect to the second rare earth magnet precursor 100 of 100 parts by mole. t is as described in "<<Rare earth magnet >>".

The first modifying material 300 is diffused and permeated into the first rare earth magnet precursor 150 and then cooled to obtain the rare earth magnet 500 of the present disclosure. The cooling rate of the first modifying material 300 after diffusion and permeation is not particularly limited. From the viewpoint of improving coercive force, the cooling rate may be, for example, 10° C./min or less, 7° C./min or less, 4° C./min or less, or 1° C./min or less. From the viewpoint of productivity, the cooling rate is, for example, 0.1° C./min or more, 0.2° C./min or more, 0.3° C./min or more, 0.5° C./min or more, or 0.6° C. or more. The cooling rate described here is a cooling rate of up to 500° C.

Manufacturing Method for First Rare Earth Magnet Precursor

Next, the manufacturing method for the first rare earth magnet precursor will be described separately for the first aspect and the second aspect.

First Aspect

In the first aspect of the manufacturing method for the first rare earth magnet precursor, the second modifying material is diffused and permeated into the inside of the second rare earth magnet precursor to obtain the first rare earth magnet precursor. The first aspect of the manufacturing method for the first rare earth magnet precursor includes a second rare earth magnet precursor preparation process, a second modifying material preparation process, and a second modifying material diffusion and permeation process. Each of these processes will be described below.

Preparation of Second Rare Earth Magnet Precursor

As illustrated in FIG. 1A, the second rare earth magnet precursor 100 in which the overall composition is represented by a formula, $(R^2_{(1-x)}R^1_x)_yFe_{(100-y-w-z-v)}Co_wB_zM^1_v$, in terms of the molar ratio, is prepared. In the formula representing the overall composition of the second rare earth magnet precursor 100, $R^1$, $R^2$ Fe, Co, B, $M^1$, and x, y, z, w, and v are as described in "<<Rare earth magnet >>".

As illustrated in FIG. 1A, the second rare earth magnet precursor 100 includes the main phase 10 and the particle boundary phase 50 present around the main phase 10. Since the second modifying material 200 is not diffused and permeated into the main phase 10 of the second rare earth magnet precursor 100, the first shell portion 30 is not formed, and the main phase 10 of the second rare earth magnet precursor 100 is not divided into the core portion 20 and the first shell portion 30. The main phase 10 of the second rare earth magnet precursor 100 has a crystal structure of an $R_2Fe_{14}B$ type.

The first rare earth magnet precursor 150 is obtained by diffusing and permeating the second modifying material 200 into the inside of the second rare earth magnet precursor 100 to form the first shell portion 30 at a temperature at which the main phase 10 of the second rare earth magnet precursor 100 is not coarsened. As a result, the average particle size of the main phase 10 of the second rare earth magnet precursor 100 and the average particle size of the main phase 10 of the first rare earth magnet precursor 150 are substantially in the same range. The average particle size and crystal structure of the main phase 10 of the second rare earth magnet precursor 100 are as described in "<<Rare earth magnet >>".

The second rare earth magnet precursor can be obtained by using a manufacturing method for a rare earth sintered magnet or a nano crystallized rare earth magnet.

The rare earth sintered magnet generally means a rare earth magnet obtained by cooling a molten metal having a composition with which an $R_2Fe_{14}B$ phase is obtained as the main phase at a rate at which the size of the main phase becomes a microlevel, thereby obtaining a thin magnetic ribbon, and sintering a green compact of the magnetic powder obtained by pulverizing the thin magnetic ribbon at a high temperature without pressurization. The magnetic powder may be powder-compacted in the magnetic field (molding in the magnetic field) to impart anisotropy to the sintered rare earth magnet (rare earth sintered magnet). In the present specification, unless otherwise specified, the $R_2Fe_{14}B$ phase means a magnetic phase having a crystal structure of an $R_2Fe_{14}B$ type.

On the other hand, the nano crystallized rare earth magnet generally means a rare earth magnet obtained by cooling a molten metal having a composition with which an $R_2Fe_{14}B$ is obtained as the main phase at a rate at which the main phase is nano crystallized, thereby obtaining a magnetic flake, and sintering the obtained magnetic flake at a low temperature with pressurization (low temperature hot press). The amorphous substance may be heat treated to obtain a nano crystallized main phase. Since it is difficult to impart anisotropy to magnetic flake having a nano crystallized main phase by molding in the magnetic field, the sintered body obtained by sintering at a low temperature with pressurization is hot-plastically processed to impart anisotropy. Such a magnet is called a hot-plastically processed rare earth magnet.

A manufacturing method for obtaining the second rare earth magnet precursor will be described separately for a case where a manufacturing method for a rare earth sintered magnet is used and a case where a manufacturing method for a nano crystallized rare earth magnet is used.

Case where Manufacturing Method for Rare Earth Sintered Magnet is Used

In a case where the second rare earth magnet precursor is obtained by using the manufacturing method for a rare earth sintered magnet, the following method can be exemplified.

A molten metal represented by a formula, $(R^2_{(1-x)}R^1_x)_y Fe_{(100-y-w-z-v)}Co_wB_zM^1_v$, in terms of the molar ratio, is cooled at a cooling rate at which the average particle size of the main phase ($R_2Fe_{14}B$ phase) is to be 1 to 20 μm, thereby obtaining a thin magnetic ribbon. The cooling rate for obtaining such a thin magnetic ribbon is, for example, 1° C./s to 1,000° C./s. In addition, examples of the method for obtaining a thin magnetic ribbon at such a cooling rate includes a strip casting method and a book molding method. The composition of the molten metal is basically the same as the overall composition of the second rare earth magnet precursor; however, for elements that may be depleted in the process of manufacturing the second rare earth magnet precursor, the depletion amount may be estimated in advance.

The thin magnetic ribbon obtained as described above is pulverized and the obtained magnetic powder is powder-compacted. Powder compacting may be performed in the magnetic field. In a case where powder compacting is performed in the magnetic field, anisotropy can be imparted to the second rare earth magnet precursor, and as a result, the anisotropy can be imparted to the rare earth magnet of the present disclosure. The molding pressure at the time of powder compacting may be, for example, 50 MPa or more, 100 MPa or more, 200 MPa or more, or 300 MPa or more, and may be 1,000 MPa or less, 800 MPa or less, or 600 MPa or less. The magnetic field to be applied may be 0.1 T or more, 0.5 T or more, 1.0 T or more, 1.5 T or more, or 2.0 T or more and may be 10.0 T or less, 8.0 T or less, 6.0 T or less, or 4.0 T or less. Examples of the crushing method include a method in which the thin magnetic ribbon is roughly pulverized and then further pulverized by a jet mill or the like. Examples of the rough pulverization method include a method of using a hammer mill, a method of hydrogen-embrittling a thin magnetic ribbon, and a combination thereof.

The green compact obtained as described above is sintered without pressurization to obtain the second rare earth magnet precursor. For sintering the green compact without pressurization such that the density of the sintered body is increased, the sintering is performed at a high temperature for long hours. The sintering temperature may be, for example, 900° C. or higher, 950° C. or higher, or 1,000° C. or higher, and may be 1,100° C. or lower, 1,050° C. or lower, or 1,040° C. or lower. The sintering time may be, for example, 1 hour or more, 2 hours or more, 3 hours or more, or 4 hours or more, and may be 24 hours or less, 18 hours or less, 12 hours or less, or 6 hours or less. For suppressing the oxidation of the green compact during sintering, the sintering atmosphere is preferably an inert gas atmosphere. The inert gas atmosphere includes a nitrogen gas atmosphere.

Regarding the main phase of the second rare earth magnet precursor, in a case where the total content proportion y of $R^1$ and $R^2$, the content proportion z of B, the cooling rate at the time of manufacturing a thin magnetic ribbon, and the like are appropriately changed, the volume fraction of the main phase to the second rare earth magnet precursor can be controlled.

In the second rare earth magnet precursor, it is better that the volume fraction of the main phase is high unless the volume fraction of the particle boundary phase is too small due to the excessive volume fraction of the main phase. In a case where the volume fraction of the main phase of the second rare earth magnet precursor is high, the volume fraction of the main phase of the rare earth magnet of the present disclosure is also high, which contributes to the increase in the residual magnetization.

On the other hand, in a case where the volume fraction of the main phase of the second rare earth magnet precursor is excessive and thus the volume fraction of the particle boundary phase is too small, although not bound by theory, the second modifying material is hardly diffused and permeated into the particle boundary phase, thereby inhibiting the formation of the first shell portion. As a result, in the rare earth magnet of the present disclosure, both the anisotropic magnetic field (coercive force) and the residual magnetization are significantly reduced.

From the viewpoint of contributing to the increase in the residual magnetization, the volume fraction of the main phase of the second rare earth magnet precursor is 90.0% or more, 90.5% or more, 91.0% or more, 92.0% or more, 94.0% or more, or 95.0% or more. On the other hand, from the viewpoint of preventing the volume fraction of the main phase of the second rare earth magnet precursor from being excessive, the volume fraction of the main phase of the second rare earth magnet precursor may be 97.0% or less, 96.5% or less, or 95.9% or less.

Case where Manufacturing Method for Nano Crystallized Rare Earth Magnet is Used

In a case where the second rare earth magnet precursor is obtained by using the manufacturing method for a nano crystallized rare earth magnet, the following method can be exemplified.

A molten metal represented by a formula, $(R^2_{(1-x)}R^1_x)_y Fe_{(100-y-w-z-v)}Co_wB_zM^1_v$, in terms of the molar ratio, is cooled at a cooling rate at which the average particle size of the main phase ($R_2Fe_{14}B$ phase) is to be 0.1 to 1.0 m and preferably 0.1 to 0.9 μm, thereby obtaining a thin magnetic ribbon. The cooling rate for obtaining such a thin magnetic ribbon is, for example, $10^{5}$° C./s to $10^{6}$° C./s. In addition, examples of the method for obtaining a thin magnetic ribbon at such a cooling rate includes a liquid quenching method. The composition of the molten metal is basically the same as the overall composition of the second rare earth magnet precursor; however, for elements that may be depleted in the process of manufacturing the second rare earth magnet precursor, the depletion amount may be estimated in advance.

The thin magnetic ribbon obtained as described above is sintered at a low temperature with pressurization. The thin magnetic ribbon may be roughly pulverized before sintering at a low temperature with pressurization. Examples of the rough pulverization method include a method of using a hammer mill, a method of hydrogen-embrittling a thin magnetic ribbon, and a combination thereof. The temperature at the time of sintering at a low temperature with pressurization is not limited as long as the main phase is coarsened and may be 550° C. or higher, 600° C. or higher, or 630° C. or higher, and may be 750° C. or lower, 700° C. or lower, or 670° C. or lower. The pressure at the time of sintering at a low temperature with pressurization may be, for example, 200 MPa or more, 300 MPa or more, or 350 MPa or more, and may be 600 MPa or less, 500 MPa or less, or 450 MPa or less.

The molded product obtained as described above may be used as it is as the second rare earth magnet precursor, or the molded product may be hot-plastically processed to impart anisotropy to the second rare earth magnet precursor. In a case of being performed as described above, anisotropy can be imparted to the rare earth magnet of the present disclosure. The temperature at the time of the hot plastic processing is not limited as long as the main phase is coarsened may be 650° C. or higher, 700° C. or higher, or 720° C. or higher, and may be 850° C. or lower, 800° C. or lower, or 770° C. or lower. The pressure at the time of the hot plastic processing may be, for example, 200 MPa or more, 300 MPa or more, 500 MPa or more, 700 MPa or more, or 900 MPa or more, and may be 3,000 MPa or less, 2,500 MPa or less, 2,000 MPa or less, 1,500 MPa or less, or 1,000 MPa or less. The reduction rate may be 10% or more, 30% or more, 50% or more, 60% or more, and may be 75% or less, 70% or less, or 65% or less. The strain rate at the time of the hot plastic processing may be 0.01/s or more, 0.1/s or more, 1.0/s or more, or 3.0/s or more, and may be 15.0/s or less, or 10.0/s or less, or 5.0/s or less.

The control of the volume fraction of the main phase with respect to the second rare earth magnet precursor is the same as that in the case of using the manufacturing method for a rare earth sintered magnet.

Preparation of Second Modifying Material

As illustrated in FIG. 1A, the second modifying material 200 having a composition represented by a formula, $R^3_{(1-p)}M^2_p$, in terms of the molar ratio, is prepared. In the formula representing the composition of the modifying material, $R^3$, $M^2$, and p are as described in "<<Rare earth magnet >>".

Examples of the preparing method for the second modifying material 200 include a method of obtaining a thin ribbon or the like from a molten metal having the composition of the second modifying material 200 by using a liquid quenching method, a strip casting method, or the like. In these methods, since the molten metal is rapidly cooled, segregation hardly occurs in the second modifying material 200. Other examples of the preparing method for the second modifying material 200 include casting a molten metal having a composition of a modifying material into a mold such as a book mold. With this method, a large amount of the second modifying material 200 can be obtained relatively easily. For reducing the segregation of the second modifying material 200, the book mold is preferably made of a material having high thermal conductivity. In addition, it is preferable that the cast material is subjected to an uniformization heat treatment to suppress segregation. Other examples of the preparing method for the second modifying material 200 includes a method of obtaining an ingot by charging a raw material of the second modifying material 200 into a container, arc-melting the raw material in the container, and then cooling the molten material. With this method, the second modifying material can be obtained relatively easily even in a case where the melting point of the raw material is high. From the viewpoint of reducing segregation of the second modifying material, it is preferable that the ingot is subjected to an uniformization heat treatment.

Diffusion and Permeation of Second Modifying Material

The diffusion and permeation temperature of the second modifying material 200 is not particularly limited as long as it is a temperature at which the second modifying material 200 can be diffused and permeated into the second rare earth magnet precursor 100. The temperature at which the second modifying material 200 can be diffused and permeated means a temperature at which the crystal structure of the main phase 10 is not disrupted by the coarsening or the like and the first shell portion 30 can be formed.

The diffusion and permeation temperature of the second modifying material 200 is typically 750° C. or higher, 775° C. or higher, or 800° C. or higher, or 1,000° C. or lower, 950° C. or lower, 925° C. or lower, or 900° C. or lower, in a case where the size of the main phase 10 of the second rare earth magnet precursor 100 is in the micrometer level. The micrometer level means that the average particle size of the main phase 10 is 1 to 20 μm.

The diffusion and permeation temperature of the second modifying material 200 is typically 600° C. or higher, 650° C. or higher, or 675° C. or higher, or 750° C. or lower, 725° C. or lower, or 700° C. or lower, in a case where main phase 10 of the second rare earth magnet precursor 100 is nano crystallized. "nano crystallized" means that the average particle size of the main phase 10 is 0.1 to 1.0 μm and preferably 0.1 to 0.9 m.

At the time of diffusion and permeation of the second modifying material 200, the second modifying material 200 of q parts by mole is brought into contact with the second rare earth magnet precursor 100 with respect to the second rare earth magnet precursor 100 of 100 parts by mole, thereby being heated. q is as described in "<<Rare earth magnet >>".

The second modifying material 200 is diffused and permeated into the second rare earth magnet precursor 100 and then cooled to obtain the first rare earth magnet precursor 150. The cooling rate of the second modifying material 200 after diffusion and permeation is not particularly limited. From the viewpoint of improving coercive force, the cooling rate may be, for example, 10° C./min or less, 7° C./min or less, 4° C./min or less, or 1° C./min or less. From the viewpoint of productivity, the cooling rate is, for example, 0.1° C./min or more, 0.2° C./min or more, 0.3° C./min or more, 0.5° C./min or more, or 0.6° C. or more. The cooling rate described here is a cooling rate of up to 500° C.

Second Aspect

In the second aspect of the manufacturing method for the first rare earth magnet precursor, the second rare earth magnet precursor powder is mixed with the second modifying material powder, the mixed powder is sintered to obtain the first rare earth magnet precursor. The second aspect of the manufacturing method for the first rare earth magnet precursor includes a second rare earth magnet precursor powder preparation process, a second modifying material powder preparation process, and a mixing and sintering process. Each of these processes will be described below.

Preparation of Second Rare Earth Magnet Precursor Powder

A molten metal having a composition represented by a formula, $(R^2_{(1-x)}R^1_x)_yFe_{(100-y-w-z-v)}Co_wB_zM^1_v$, in terms of the molar ratio, is cooled at a cooling rate at which the average particle size of the main phase ($R_2Fe_{14}B$ phase) is to be 0.1 μm to 20 μm, thereby obtaining a thin magnetic ribbon. This thin magnetic ribbon is pulverized to obtain a magnetic powder. Examples of the crushing method include a method in which the thin magnetic ribbon is roughly pulverized and then further pulverized by a jet mill or the like. Examples of the rough pulverization method include a method of using a hammer mill, a method of hydrogen-embrittling a thin magnetic ribbon, and a combination thereof.

In the formula representing the composition of the molten metal, $R^1$, $R^2$ Fe, Co, B, $M^1$ and x, y, z, w, and v are as described in "<<Rare earth magnet >>". The composition of the molten metal is basically the same as the overall composition of the second rare earth magnet precursor powder; however, for elements that may be depleted in the process of manufacturing the second rare earth magnet precursor powder, the depletion amount may be estimated in advance.

The cooling rate for obtaining a thin magnetic ribbon having the main phase having an average particle size of 1 to 20 μm is, for example, 1° C./s to 1,000° C./s. In addition, examples of the method for obtaining a thin magnetic ribbon at such a cooling rate includes a strip casting method and a book molding method. The cooling rate for obtaining a thin magnetic ribbon having the main phase having an average particle size of 0.1 to 1.0 μm and preferably 0.1 to 0.9 μm is, for example, $10^{5°}$ C./s to $10^{6°}$ C./s. Examples of the method for obtaining a thin magnetic ribbon at such a cooling rate includes a liquid quenching method.

Preparation of Second Modifying Material Powder

The second modifying material powder having a composition represented by a formula, $R^3_{(1-p)}M^2_p$, in terms of the molar ratio, is prepared. In the formula representing the composition of the modifying material powder, $R^3$, $M^2$, and p are as described in "<<Rare earth magnet >>".

Examples of the preparing method for the second modifying material powder include a method of obtaining a thin ribbon or the like from a molten metal having the composition of the second modifying material powder by using a liquid quenching method, a strip casting method, or the like, and pulverizing the obtained thin ribbon. In this method, since the molten metal is rapidly cooled, segregation hardly occurs in the second modifying material powder. Other examples of the preparing method for the second modifying material powder include casting a molten metal having a composition of a second modifying material powder into a mold such as a book mold and then pulverizing the cast material. With this method, a large amount of the second modifying material powder can be obtained relatively easily. For reducing the segregation of the second modifying material powder, the book mold is preferably made of a material having high thermal conductivity. In addition, it is preferable that the cast material is subjected to an uniformization heat treatment to suppress segregation. Other examples of the preparing method for the second modifying material powder includes a method of obtaining an ingot by charging a raw material of the second modifying material powder into a container, arc-melting the raw material in the container, cooling the molten material to obtain the ingot, and then pulverizing the obtained ingot. With this method, the second modifying material powder can be obtained relatively easily even in a case where the melting point of the raw material is high. From the viewpoint of reducing segregation of the second modifying material powder, it is preferable that the ingot is subjected to an uniformization heat treatment in advance.

Mixed Sintering

The second rare earth magnet precursor powder and the second modifying material powder are mixed and sintered. After mixing and before sintering, a mixed powder of the second rare earth magnet precursor powder and the second modifying material powder may be powder-compacted.

In a case where the average particle size of the main phase in the second rare earth magnet precursor powder is 1 to 20 μm, the powder compacting may be carried out in the magnetic field. In a case where powder compacting is performed in the magnetic field, anisotropy can be imparted to the green compact, and as a result, the anisotropy can be imparted to the rare earth magnet of the present disclosure. The molding pressure at the time of powder compacting may be, for example, 50 MPa or more, 100 MPa or more, 200 MPa or more, or 300 MPa or more, and may be 1,000 MPa or less, 800 MPa or less, or 600 MPa or less. The magnetic field to be applied may be 0.1 T or more, 0.5 T or more, 1.0 T or more, 1.5 T or more, or 2.0 T or more and may be 10.0 T or less, 8.0 T or less, 6.0 T or less, or 4.0 T or less.

The green compact obtained as described above is sintered without pressurization to obtain the first rare earth magnet precursor. For sintering the green compact without pressurization such that the density of the sintered body is increased, the sintering is performed at a high temperature for long hours. The sintering temperature may be, for example, 900° C. or higher, 950° C. or higher, or 1,000° C. or higher, and may be 1,100° C. or lower, 1,050° C. or lower, or 1,040° C. or lower. The sintering time may be, for example, 1 hour or more, 2 hours or more, 3 hours or more, or 4 hours or more, and may be 24 hours or less, 18 hours or less, 12 hours or less, or 6 hours or less. For suppressing the oxidation of the green compact during sintering, the sintering atmosphere is preferably an inert gas atmosphere. The inert gas atmosphere includes a nitrogen gas atmosphere.

In a case of being sintered without pressurization in this manner, not only a sintered body is obtained, but also the second modifying material is diffused and permeated through the particle boundary phase in the second rare earth magnet precursor powder. Then, the light rare earth element present in the vicinity of the surface layer portion of the main phase is substituted with Nd and/or Pr of the second modifying material, the core portion and the first shell portion is formed, and the first rare earth magnet precursor is formed.

In a case where the average particle size of the main phase in the second rare earth magnet precursor powder is 0.1 to 1.0 μm and preferably 0.1 to 0.9 μm, sintering at a low temperature with pressurization is performed, for example, at a temperature at which the main phase is not coarsened. The temperature at the time of sintering at a low temperature with pressurization may be, for example, 550° C. or higher, 600° C. or higher, or 630° C. or higher, and may be 750° C. or lower, 700° C. or lower, or 670° C. or lower. The pressure at the time of sintering at a low temperature with pressurization may be, for example, 200 MPa or more, 300 MPa or more, or 350 MPa or more, and may be 600 MPa or less, 500 MPa or less, or 450 MPa or less.

The sintered body obtained as described above may be used as it is as the second rare earth magnet precursor, or the sintered body may be hot-plastically processed to impart anisotropy to the second rare earth magnet precursor. In a case of being performed as described above, anisotropy can be imparted to the rare earth magnet of the present disclosure. The temperature at the time of the hot plastic processing is not limited as long as the main phase is coarsened may be 650° C. or higher, 700° C. or higher, or 720° C. or higher, and may be 850° C. or lower, 800° C. or lower, or 770° C. or lower. The pressure at the time of the hot plastic processing may be, for example, 200 MPa or more, 300 MPa or more, 500 MPa or more, 700 MPa or more, or 900 MPa or more, and may be 3,000 MPa or less, 2,500 MPa or less, 2,000 MPa or less, 1,500 MPa or less, or 1,000 MPa or less. The reduction rate may be 10% or more, 30% or more, 50% or more, 60% or more, and may be 75% or less, 70% or less, or 65% or less. The strain rate at the time of the hot plastic processing may be 0.01/s or more, 0.1/s or more, 1.0/s or more, or 3.0/s or more, and may be 15.0/s or less, or 10.0/s or less, or 5.0/s or less.

The control of the volume fraction of the main phase with respect to the second rare earth magnet precursor is the same as that in the case (the second aspect) of using the dual alloy method and that in the case (the first aspect) of using the manufacturing method for a rare earth sintered magnet.

Deformation

In addition to what has been described above, the rare earth magnet and the manufacturing method for the rare earth magnet of the present disclosure can be modified in various ways within the scope of the contents described in "WHAT IS CLAIMED". For example, after diffusing the first modifying material into the first rare earth magnet precursor, the rare earth magnet may be additionally heat-treated to obtain the rare earth magnet of the present disclosure. Although not bound by theory, it is presumed that due to this heat treatment, a part of the particle boundary phase after the first modifying material has been diffused and permeated without changing the structure of the main phase (without melting) is melted, the molten material is solidified, and the solidified body uniformly covers the main phase, which contributes to the increase in the coercive force.

For utilizing the above-mentioned effect of increasing the coercive force, the heat treatment temperature is preferably 400° C. or higher, more preferably 425° C. or higher, and still more preferably 450° C. or higher. On the other hand, for avoiding the change of the structure of the main phase, the heat treatment temperature is preferably 600° C. or lower, more preferably 575° C. or lower, and still more preferably 550° C. or lower.

For avoiding the oxidation of the rare earth magnet of the present disclosure, heat treatment is preferably performed in an inert gas atmosphere. The inert gas atmosphere includes a nitrogen gas atmosphere.

Hereinafter, the rare earth magnet and the manufacturing method therefor of the present disclosure will be described in more detail with reference to Examples and Comparative Examples. The rare earth magnet and the manufacturing method therefor of the present disclosure are not limited to the conditions used in Examples below.

Preparation of Sample

Samples of Examples 1 to 5 and Comparative Examples 1 to 5 were prepared by the following procedure.

Preparation of Sample of Example 1

As the second rare earth magnet precursor, a rare earth sintered magnet of which the overall composition was represented by $Nd_{6.6}Ce_{4.9}La_{1.6}Fe_{ba1}B_{6.0}Cu_{0.1}Ga_{0.3}$, in terms of the molar ratio, was prepared. Anisotropy was imparted to the second rare earth magnet precursor by molding in the magnetic field. The second modifying material containing a $Nd_{0.9}Cu_{0.1}$ alloy was diffused and permeated into the second rare earth magnet precursor at 950° C. to obtain the first rare earth magnet precursor. The second modifying material of 4.7 parts by mole was diffused and permeated into the second rare earth magnet precursor of 100 parts by mole. The first modifying material containing a $Tb_{0.82}Ga_{0.15}$ alloy was diffused and permeated into the first rare earth magnet precursor at 900° C. to obtain a sample of Example 1. The first modifying material of 1.5 parts by mole was diffused and permeated into the second rare earth magnet precursor of 100 parts by mole.

Preparation of Sample of Example 2

As the second rare earth magnet precursor powder, a magnetic powder of which the overall composition was represented by $Nd_{6.6}Ce_{4.9}La_{1.6}Fe_{ba1}B_{6.0}Cu_{0.1}Ga_{0.3}$, in terms of the molar ratio, was prepared. In addition, the second modifying material powder containing a $Nd_{0.9}Cu_{0.1}$ alloy was prepared. The second rare earth magnet precursor powder and the second modifying material powder were mixed to obtain a mixed powder. The second modifying material powder of 4.7 parts by mole was mixed with the second rare earth magnet precursor powder of 100 parts by mole. This mixed powder was molded in the magnetic field and sintered at 1,050° C. to obtain the first rare earth magnet precursor. Then, the first modifying material containing a $Tb_{0.82}Ga_{0.15}$ alloy was diffused and permeated into the first rare earth magnet precursor at 900° C. to obtain a sample of Example 2. The first modifying material of 1.5 parts by mole was diffused and permeated into the second rare earth magnet precursor of 100 parts by mole.

Preparation of Sample of Example 3

As a second rare earth magnet precursor, a hot-plastically processed rare earth magnet of which the overall composition was represented by $Nd_{6.6}Ce_{4.9}La_{1.6}Fe_{ba1}B_{6.0}Cu_{0.1}Ga_{0.3}$, in terms of the molar ratio, was prepared. The second modifying material containing a $Nd_{0.7}Cu_{0.3}$ alloy was diffused and permeated at 700° C. to obtain the first rare earth magnet precursor. The second modifying material of 5.5 parts by mole was diffused and permeated into the second rare earth magnet precursor of 100 parts by mole. Then, the first modifying material containing a $Nd_{0.6}Tb_{0.2}Ga_{0.2}$ alloy was diffused and permeated into the first rare earth magnet precursor at 675° C. to obtain a sample of Example 3. The first modifying material of 1.5 parts by mole was diffused and permeated into the second rare earth magnet precursor of 100 parts by mole.

Preparation of Sample of Comparative Example 1

A sample of Comparative Example 1 was prepared in the same manner as in Example 1, except that the second modifying material was not diffused and permeated into the second rare earth magnet precursor and the first modifying material was diffused and permeated into the second rare earth magnet precursor.

Preparation of Sample of Comparative Example 2

A sample of Comparative Example 2 was prepared in the same manner as in Example 3, except that the second modifying material was not diffused and permeated into the second rare earth magnet precursor and the first modifying material was diffused and permeated into the second rare earth magnet precursor.

Preparation of Sample of Comparative Example 3

A sample of Comparative Example 3 was prepared in the same manner as in Example 2, except that the first modifying material was not diffused and permeated after a rare earth sintered magnet was prepared as the second rare earth magnet precursor and the second modifying material was diffused and permeated into the second rare earth magnet precursor.

Preparation of Sample of Comparative Example 4

A sample of Comparative Example 4 was prepared in the same manner as in Example 3, except that the first modifying material was not diffused and permeated.

Preparation of Sample of Example 4

A sample of Example 4 was prepared in the same manner as in Example 1, except that the diffusion and permeation temperature of the first modifying material was 850° C.

Preparation of Sample of Example 5

A sample of Example 5 was prepared in the same manner as in Example 1, except that the diffusion and permeation temperature of the first modifying material was 800° C.

Preparation of Sample of Comparative Example 5

A sample of Comparative Example 5 was prepared in the same manner as in Example 1, except that the diffusion and permeation temperature of the first modifying material was 950° C.

Evaluation

The magnetic characteristics of each sample were measured at 300 K and 453 K using a vibrating sample magnetometer (VSM). In addition, the core portion, the first shell portion, and the second shell portion of each of the samples were subjected to a composition analysis using a Scanning Transmission Electron Microscope-Energy Dispersive X-ray Spectroscope (STEM-EDX). The sample of Example 1 was subjected to the structure observation and the component analysis using STEM-EDX. The sample of Comparative Example 1 was subjected to a component analysis (surface analysis) using a Scanning Electron Microscope-Energy Dispersive X-ray Spectroscope (SEM-EDX). In addition, the average particle size of the main phase of each sample was determined by the method described in "<<Rare earth magnet >>".

Figure 3A:
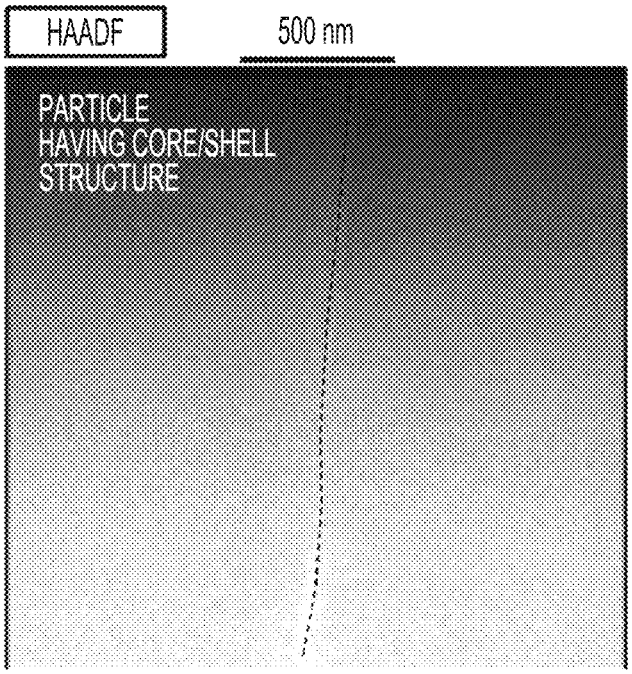
FIG. 3A is an image showing a result obtained by structure observation of a sample of Example 1 using STEM-EDX.
Figure 3B:
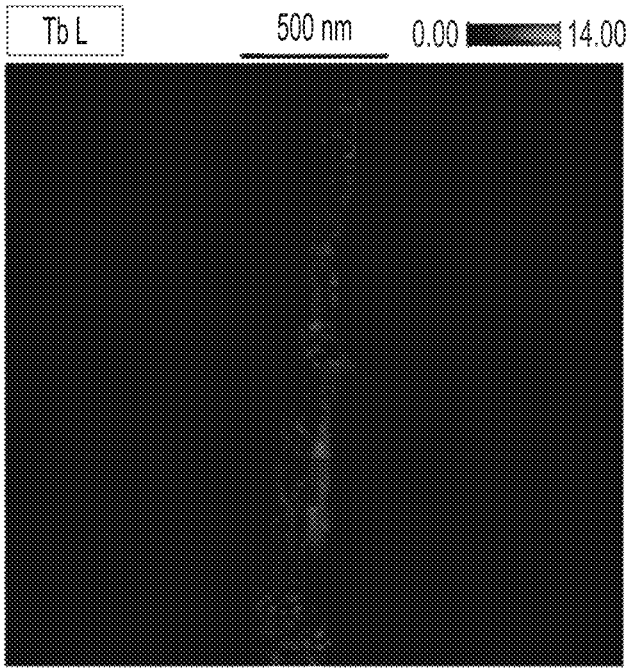
FIG. 3B is an image showing a result obtained by surface analysis of Tb in the area shown illustrated in FIG. 3A using STEM-EDX.
Figure 3C:
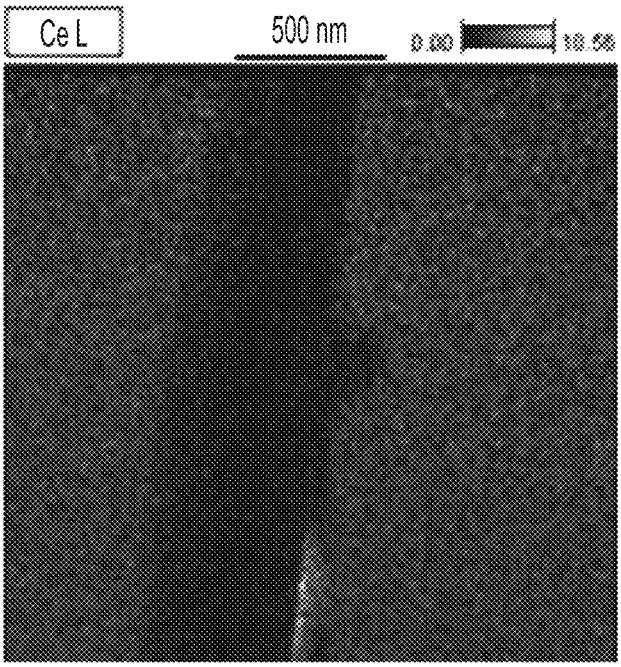
FIG. 3C is an image showing a result obtained by surface analysis of Ce in the area shown illustrated in FIG. 3A using STEM-EDX.
Figure 3D:
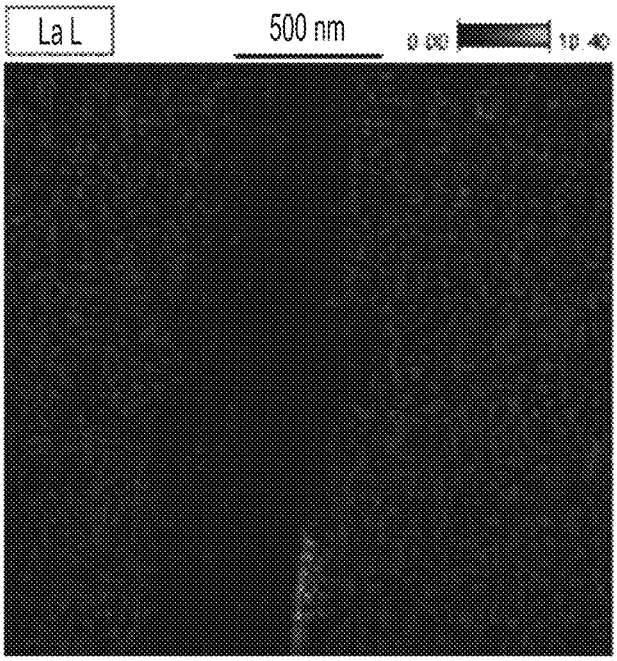
FIG. 3D is an image showing a result obtained by surface analysis of La in the area shown illustrated in FIG. 3A using STEM-EDX.
Figure 3E:
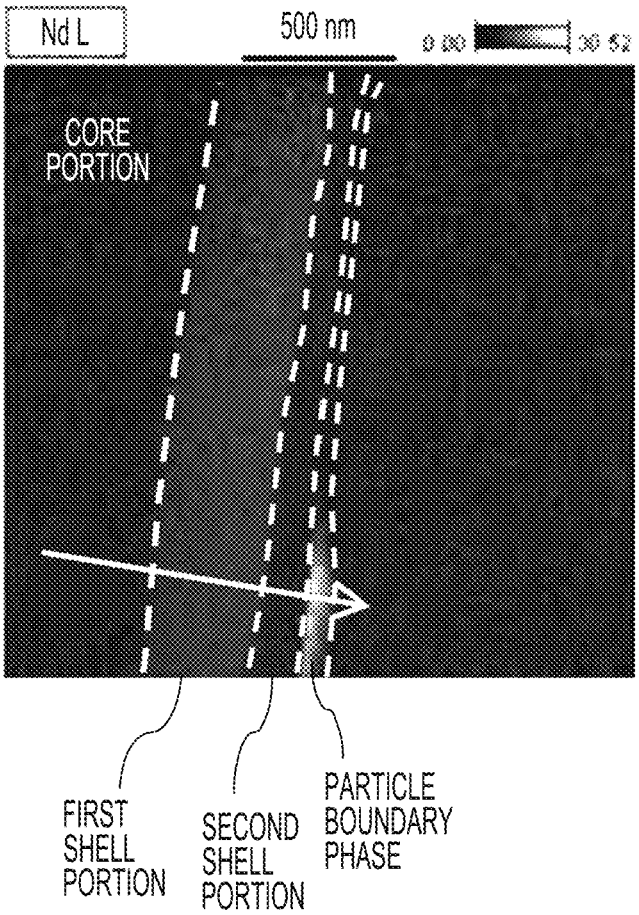
FIG. 3E is an image showing a result obtained by surface analysis of Nd in the area shown illustrated in FIG. 3A using STEM-EDX.

The results are shown in Table 1-1 and Table 1-2. FIG. 3A is an image showing a result obtained by structure observation of a sample of Example 1 using STEM-EDX. FIG. 3B is an image showing a result obtained by surface analysis of Tb in the area shown illustrated in FIG. 3A using STEM-EDX. FIG. 3C is an image showing a result obtained by surface analysis of Ce in the area shown illustrated in FIG. 3A using STEM-EDX. FIG. 3D is an image showing a result obtained by surface analysis of La in the area shown illustrated in FIG. 3A using STEM-EDX. FIG. 3E is an image showing a result obtained by surface analysis of Nd in the area shown illustrated in FIG. 3A using STEM-EDX.

Figure 4A:
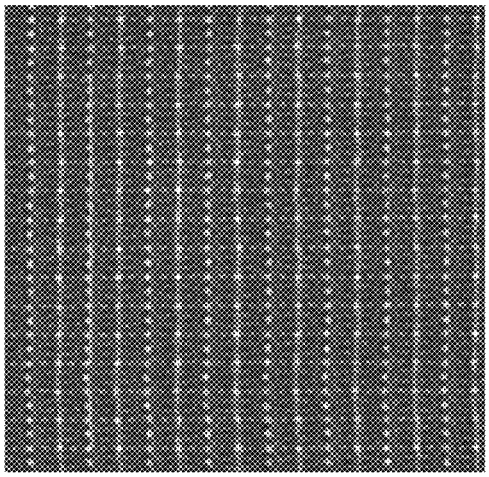
FIG. 4A is a high-resolution STEM image showing a crystal structure of a core portion in the sample of Example 1 in an <110> incident direction.
Figure 4B:
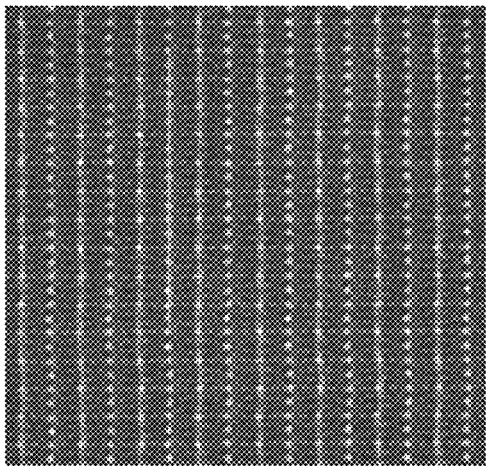
FIG. 4B is a high-resolution STEM image showing a crystal structure of a first shell portion in the sample of Example 1 in an <110> incident direction.
Figure 4C:
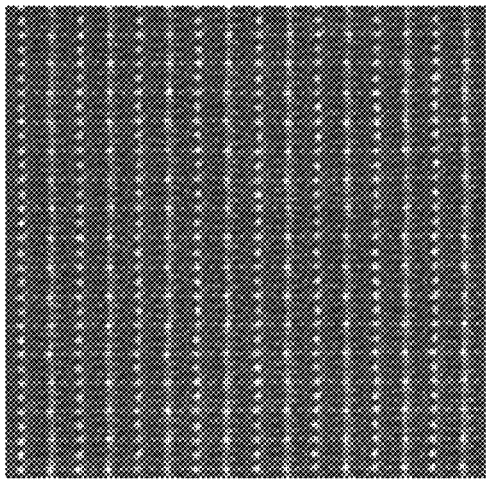
FIG. 4C is a high-resolution STEM image showing a crystal structure of a second shell portion in the sample of Example 1 in an <110> incident direction.
Figure 5:
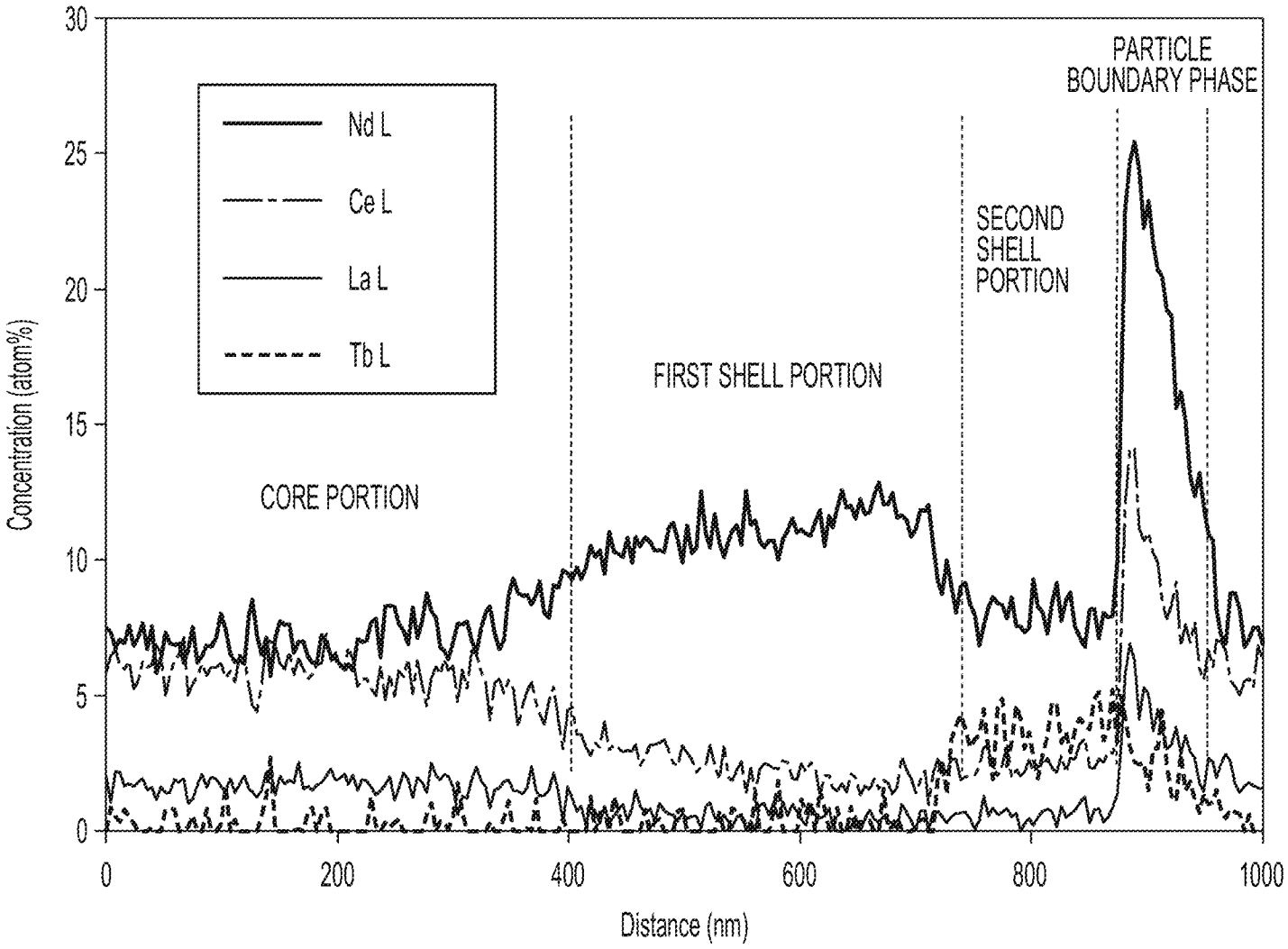
FIG. 5 is a graph showing a result obtained by line analysis in the sample of Example 1 in a direction of the arrow indicated in FIG. 3E using STEM-EDX.
Figure 6A:
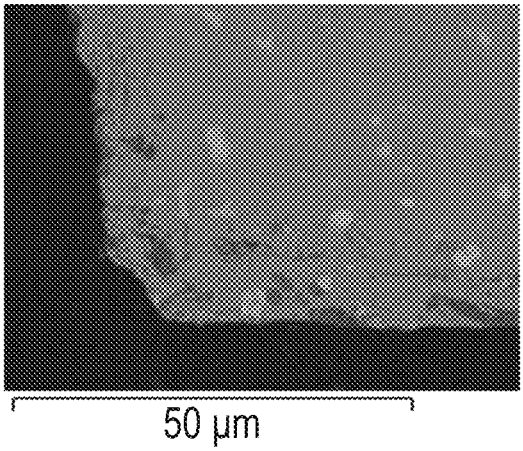
FIG. 6A is an image showing a result obtained by structure observation of a sample of Comparative Example 1 using SEM-EDX.
Figure 6B:
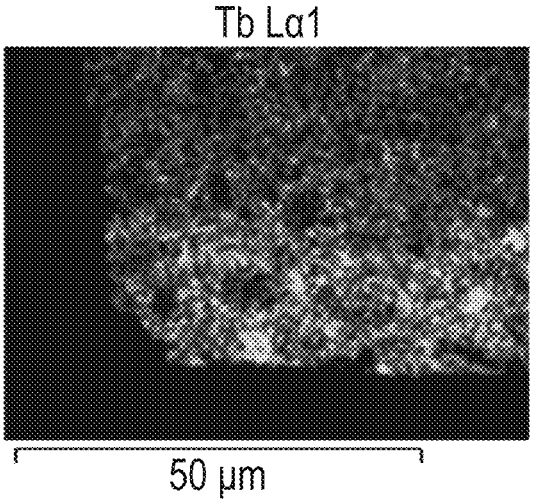
FIG. 6B is an image showing a result obtained by surface analysis of Tb in the area shown illustrated in FIG. 6A using SEM-EDX.
Figure 6C:
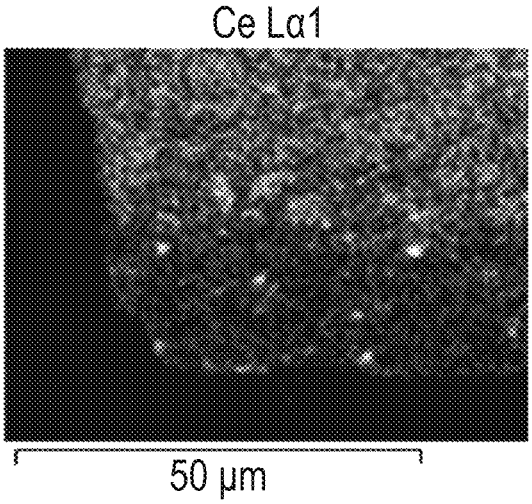
FIG. 6C is an image showing a result obtained by surface analysis of Ce in the area shown illustrated in FIG. 6A using SEM-EDX.
Figure 6D:
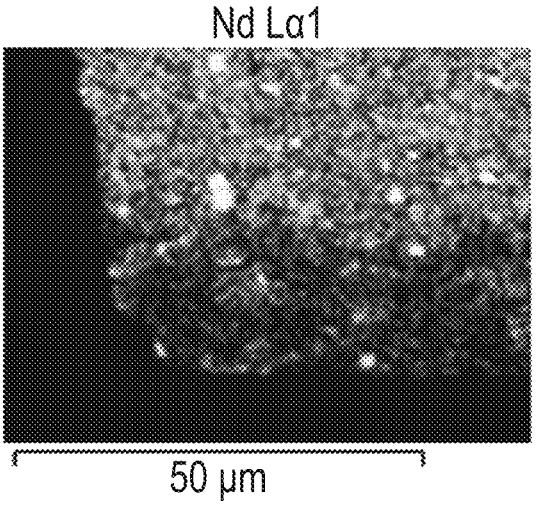
FIG. 6D is an image showing a result obtained by surface analysis of Nd in the area shown illustrated in FIG. 6A using SEM-EDX.

FIG. 4A is a high-resolution STEM image showing a crystal structure of a core portion in the sample of Example 1 in an <110> incident direction. FIG. 4B is a high-resolution STEM image showing a crystal structure of a first shell portion in the sample of Example 1 in an <110> incident direction. FIG. 4C is a high-resolution STEM image showing a crystal structure of a second shell portion in the sample of Example 1 in an <110> incident direction. FIG. 5 is a graph showing a result obtained by line analysis in the sample of Example 1 in a direction of the arrow indicated in FIG. 3E using STEM-EDX. FIG. 6A is an image showing a result obtained by structure observation of a sample of Comparative Example 1 using SEM-EDX. FIG. 6B is an image showing a result obtained by surface analysis of Tb in the area shown illustrated in FIG. 6A using SEM-EDX. FIG. 6C is an image showing a result obtained by surface analysis of Ce in the area shown illustrated in FIG. 6A using SEM-EDX. FIG. 6D is an image showing a result obtained by surface analysis of Nd in the area shown illustrated in FIG. 6A using SEM-EDX; In the surface analysis results, the portion where the concentration of the indicated element is high is shown in the bright field.

TABLE 1-1

| | First rare earth magnetic precursor | | | | | |
|---|---|---|---|---|---|---|
| | Second rare earth magnetic precursor | | | Second modifying material | | |
| | Composition (notation 1) | Composition (notation 2) | Manufacturing method | Composition | Permeation amount q (parts by mole) | Permeation method |
| Example 1 | Nd6.6 Ce4.9 La1.6 FebalB6 Cu0.1 Ga0.3 | (Nd0.5 Ce0.38 La0.12)13.1 FebalB6 Cu0.1 Ga0.3 | Sintered magnet | Nd0.9 Cu0.1 | 4.7 | Particle boundary diffusion |
| Example 2 | Nd6.6 Ce4.9 La1.6 FebalB6 Cu0.1 Ga0.3 | (Nd0.5 Ce0.38 La0.12)13.1 FebalB6 Cu0.1 Ga0.3 | Sintered magnet | Nd0.9 Cu0.1 | 4.7 | Dual alloy |
| Example 3 | Nd6.6 Ce4.9 La1.6 FebalB6 Cu0.1 Ga0.3 | (Nd0.5 Ce0.38 La0.12)13.1 FebalB6 Cu0.1 Ga0.3 | Hot-plastically processed magnet | Nd0.7 Cu0.3 | 5.5 | Particle boundary diffusion |
| Comparative Example 1 | Nd6.6 Ce4.9 La1.6 FebalB6 Cu0.1 Ga0.3 | (Nd0.5 Ce0.38 La0.12)13.1 FebalB6 Cu0.1 Ga0.3 | Sintered magnet | — | — | — |
| Comparative Example 2 | Nd6.6 Ce4.9 La1.6 FebalB6 Cu0.1 Ga0.3 | (Nd0.5 Ce0.38 La0.12) 13.1 FebalB6 Cu0.1 Ga0.3 | Hot-plastically processed magnet | — | — | — |
| Comparative Example 3 | Nd6.6 Ce4.9 La1.6 FebalB6 Cu0.1 Ga0.3 | (Nd0.5 Ce0.38 La0.12)13.1 FebalB6 Cu0.1 Ga0.3 | Sintered magnet | Nd0.9 Cu0.1 | 4.7 | Particle boundary diffusion |
| Comparative Example 4 | Nd6.6 Ce4.9 La1.6 FebalB6 Cu0.1 Ga0.3 | (Nd0.5 Ce0.38 La0.12)13.1 FebalB6 Cu0.1 Ga0.3 | Hot-plastically processed magnet | Nd0.7 Cu0.3 | 5.5 | Particle boundary diffusion |
| Example 4 | Nd6.6 Ce4.9 La1.6 FebalB6 Cu0.1 Ga0.3 | (Nd0.5 Ce0.38 La0.12)13.1 FebalB6 Cu0.1 Ga0.3 | Sintered magnet | Nd0.9 Cu0.1 | 4.7 | Particle boundary diffusion |
| Example 5 | Nd6.6 Ce4.9 La11.6 FebalB6 Cu0.1 Ga0.3 | (Nd0.5Ce0.38 La0.12)13.1 FebalB6 Cu0.1 Ga0.3 | Sintered magnet | Nd0.9 Cu0.1 | 4.7 | Particle boundary diffusion |
| Comparative Example 5 | Nd6.6 Ce4.9 La1.6 FebalB6 Cu0.1 Ga0.3 | (Nd0.5 Ce0.38 La0.12)13.1 FebalB6 Cu0.1 Ga0.3 | Sintered magnet | Nd0.9 Cu0.1 | 4.7 | Particle boundary diffusion |

| | First rare earth magnetic precursor | First modifying material | | | Heat treatment temperature after |
|---|---|---|---|---|---|
| | Second modifying material Permeation temperature (° C.) | Composition | Permeation amount t (parts by mole) | Permeation temperature (° C.) | diffusion and permeation (° C.) |
| Example 1 | 950 | Tb0.82 Ga0.12 | 1.5 | 900 | — |
| Example 2 | 1,050 | Tb0.82 Ga0.12 | 1.5 | 900 | — |
| Example 3 | 700 | Nd0.6 Tb0.2 Cu0.2 | 1.5 | 675 | — |
| Comparative Example 1 | — | Tb0.82 Ga0.12 | 1.5 | 950 | — |
| Comparative Example 2 | — | Nd0.6 Tb0.2 Cu0.2 | 1.5 | 675 | — |
| Comparative Example 3 | 950 | — | — | — | 550 |
| Comparative Example 4 | 700 | — | — | — | — |

TABLE 1-1-continued

| | | | | | |
|---|---|---|---|---|---|
| Example 4 | 950 | Tb0.82 Ga0.12 | 1.5 | 850 | 450 |
| Example 5 | 950 | Tb0.82 Ga0.12 | 1.5 | 800 | 450 |
| Comparative Example 5 | 950 | Tb0.82 Ga0.12 | 1.5 | 950 | 450 |

TABLE 1-2

| | Main phase | | | | |
|---|---|---|---|---|---|
| | Core portion rare earth molar ratio | First shell portion rare earth molar ratio | Second shell portion rare earth molar ratio | Average particle size (μmm) | Particle boundary phase rare earth molar ratio |
| Example 1 | Nd0.5 Ce0.38 La0.12 | Nd0.88 Ce0.11 La0.01 | Nd0.66 Ce0.12 Tb0.22 | 6.1 | Nd0.49 Ce0.29 La0.14 Tb0.08 |
| Example 2 | Nd0.5 Ce0.38 La0.12 | Nd0.82 Ce0.16 La0.02 | Nd0.6 Ce0.17 Tb0.23 | 6.1 | Nd0.51 Ce0.27 La0.14 Tb0.08 |
| Example 3 | Nd0.5 Ce0.38 La0.12 | Nd0.7 Ce0.19 La0.11 | Nd0.56 Ce0.22 Tb0.22 | 0.35 | Nd0.55 Ce0.23 La0.12 Tb0.1 |
| Comparative Example 1 | Nd0.5 Ce0.38 La0.12 | — | — | 6.1 | Nd0.44 Ce0.15 La0.07 Tb0.33 |
| Comparative Example 2 | Nd0.5 Ce0.38 La0.12 | — | — | 0.35 | Nd0.47 Ce0.17 La0.05 Tb0.31 |
| Comparative Example 3 | Nd0.5 Ce0.38 La0.12 | Nd0.88 Ce0.11 La0.01 | — | 6.1 | Nd0.53 Ce0.32 La0.15 |
| Comparative Example 4 | Nd0.5 Ce0.38 La0.12 | Nd0.7 Ce0.19 La0.11 | — | 0.35 | Nd0.49 Ce0.34 La0.17 |
| Example 4 | Nd0.5 Ce0.38 La0.12 | Nd0.88 Ce0.11 La0.01 | Nd0.61 Ce0.11 Tb0.28 | 6.1 | Nd0.5 Ce0.3 La0.13 Tb0.07 |
| Example 5 | Nd0.5 Ce0.38 La0.12 | Nd0.88 Ce0.11 La0.01 | Nd0.59 Ce0.1 Tb0.31 | 6.1 | Nd0.52 Ce0.28 La0.13 Tb0.07 |
| Comparative Example 5 | Nd0.5 Ce0.38 La0.12 | — | — | 6.1 | Nd0.51 Ce0.29 La0.12 Tb0.08 |

| | Nd, Pr concentration ratio (first shell portion/core portion) | Nd, Pr concentration ratio (second shell portion/first shell portion) | Heavy rare earth concentration ratio (second shell portion/ particle boundary portion) | 300K coercive force (kA/m) | 453K coercive force (kA/m) | 300K residual magnetization (T) |
|---|---|---|---|---|---|---|
| Example 1 | 1.76 | 0.75 | 2.75 | 875.4 | 254.6 | 1.25 |
| Example 2 | 1.64 | 0.73 | 2.88 | 795.8 | 246.7 | 1.2 |
| Example 3 | 1.40 | 0.80 | 2.20 | 1607.5 | 485.4 | 1.21 |
| Comparative Example 1 | — | — | 1.03 | 167.1 | 31.8 | 1.22 |
| Comparative Example 2 | — | — | 1.03 | 756.0 | 214.9 | 1.21 |
| Comparative Example 3 | 1.76 | — | — | 660.5 | 167.1 | 1.28 |
| Comparative Example 4 | 1.40 | — | — | 859.4 | 222.8 | 1.25 |
| Example 4 | 1.76 | 0.69 | 4.00 | 899.2 | 270.6 | 1.23 |
| Example 5 | 1.76 | 0.67 | 4.43 | 923.1 | 278.5 | 1.23 |
| Comparative Example 5 | — | — | 4.25 | 342.2 | 87.5 | 1.25 |

From Table 1-1 and Table 1-2, it can be seen that the samples of Examples 1 to 5 including the first shell portion and the second shell portion have an increased coercive force. Further, from FIG. 3A to FIG. 3E, it can be seen that in the sample of Example 1, the existence proportion of Nd is higher in the first shell portion than in the core portion, the existence proportion of Nd is lower in the second shell portion than in the first shell portion, and Tb is present in the second shell portion. The same can be seen from FIG. 5. Further, from FIG. 4A to FIG. 4C, it can be seen that the same crystal lattice pattern is observed in all of the core portion, the first shell portion, and the second shell portion in the sample of Example 1, all of the core portion, the first shell portion, and the second shell portion have a crystal structure of an $R_2Fe_{14}B$ type. FIG. 6A to FIG. 6D show results obtained by surface analysis of the sample (Comparative Example 1) after the modifying material containing the $Tb_{0.82}$ $Ga_{0.12}$ alloy has been diffused and permeated from the lower side of the figure, without forming the first shell phase. In these figures, Tb is present in a high concentration solely on the lower side of the figure and it can be seen that Tb is not spread to the inside of the rare earth magnet.

From the above results, the effects of the rare earth magnet and the manufacturing method therefor of the present disclosure could be confirmed.

What is claimed is:

1. A rare earth magnet comprising:

a main phase; and a particle boundary phase present around the main phase, wherein:

an overall composition in terms of a molar ratio is represented by a formula, $(R^2_{(1-x)}R^1_x)_yFe_{(100-y-w-z-v)}Co_wB_zM^1_v\cdot(R^3_{(1-p)}M^2_p)_q\cdot(R^4_{(1-s)}M^3_s)_t$, where $R^1$ is one or more elements selected from the group consisting of Ce, La, Y, and Sc; $R^2$ and $R^3$ are one or more elements selected from the group consisting of Nd and Pr; $R^4$ is a rare earth element at least including one or more elements selected from the group consisting of Gd, Tb, Dy, Nd and Ho; $M^1$ is one or more elements selected from the group consisting of Ga, Al, Cu, Au, Ag, Zn, In, and Mn, and an unavoidable impurity element; $M^2$ is a metal element other than rare earth elements, which is alloyed with $R^3$, and an unavoidable impurity element; and $M^3$ is a metal element other than rare earth elements, that is alloyed with $R^4$, and an unavoidable impurity element; and the followings are satisfied, $0.1 \le x \le 1.0$, $12.0 \le y \le 20.0$, $5.0 \le z \le 20.0$, $0 \le w \le 8.0$, $0 \le v \le 2.0$, $0.05 \le p \le 0.40$, $0.1 \le q \le 15.0$, $0.05 \le s \le 0.40$, and $0.1 \le t \le 5.0$);

the main phase has a crystal structure of $R_2Fe_{14}B$, optionally having substitution and/or intrusion of an additional element, where R is a rare earth element;

an average particle size of the main phase is 0.1 μm to 20 μm;

the main phase has a core portion, a first shell portion present around the core portion, and a second shell portion present around the first shell portion;

a total of molar ratios of Nd and Pr in the first shell portion is higher than a total of molar ratios of Nd and Pr in the core portion;

a total of molar ratios of Nd and Pr in the second shell portion is lower than a total of molar ratios of Nd and Pr in the first shell portion;

the second shell portion contains one or more elements selected from the group consisting of Gd, Tb, Dy, and Ho;

a total of molar ratios of Gd, Tb, Dy, and Ho in the second shell portion is higher than a total of molar ratios of Gd, Tb, Dy, and Ho in the core portion; and a total of molar ratios of Gd, Tb, Dy, and Ho in the second shell portion is higher than a total of molar ratios of Gd, Tb, Dy, and Ho in the first shell portion.

2. The rare earth magnet according to claim 1, wherein, the x satisfies $0.5 \le x \le 1.0$.

3. The rare earth magnet according to claim 1, wherein:

the $R^1$ is one or more elements selected from the group consisting of Ce and La;

the $R^2$ and the $R^3$ are Nd; and the $R^4$ is one or more elements selected from the group consisting of Tb and Nd.

4. The rare earth magnet according to claim 1, wherein:

a total of molar ratios of Nd and Pr in the first shell portion is 1.2 times to 3.0 times the total of molar ratios of Nd and Pr in the core portion;

a total of molar ratios of Nd and Pr in the second shell portion is 0.5 times to 0.9 times the total of molar ratios of Nd and Pr in the first shell portion;

a total of molar ratios of Gd, Tb, Dy, and Ho in the second shell portion is at least 2.0 times the total of molar ratios of Gd, Tb, Dy, and Ho in the core portion; and a total of molar ratios of Gd, Tb, Dy, and Ho in the second shell portion is at least 2.0 times the total of molar ratios of Gd, Tb, Dy, and Ho in the first shell portion.

5. A manufacturing method for the rare earth magnet according to claim 1, the manufacturing method comprising:

preparing a first rare earth magnet precursor that includes a main phase and a particle boundary phase present around the main phase and in which an overall composition in terms of a molar ratio is represented by a formula, $(R^2_{(1-x)}R^1_x)_yFe_{(100-y-w-z-v)}Co_wB_zM^1_v\cdot(R^3_{(1-p)}M^2_p)_q$, where $R^1$ is one or more elements selected from the group consisting of Ce, La, Y, and Sc; $R^2$ and $R^3$ are one or more elements selected from the group consisting of Nd and Pr; $M^1$ is one or more elements selected from the group consisting of Ga, Al, Cu, Au, Ag, Zn, In, and Mn, and an unavoidable impurity element; and $M^2$ is a metal element other than rare earth elements, which is alloyed with $R^3$, and an unavoidable impurity element; and the followings are satisfied, $0.1 \le x \le 1.0$, $12.0 \le y \le 20.0$, $5.0 \le z \le 20.0$, $0 \le w \le 8.0$, $0 \le v \le 2.0$, $0.05 \le p \le 0.40$, and $0.1 \le q \le 15.0$;

the main phase has a crystal structure of $R_2Fe_{14}B$, optionally having substitution and/or intrusion of an additional element, where R is a rare earth element, an average particle size of the main phase is 0.1 μm to 20 μm, the main phase includes a core portion and a first shell portion present around the core portion, and a total of molar ratios of Nd and Pr in the first shell portion is higher than a total of molar ratios of Nd and Pr in the core portion;

preparing a first modifying material having a composition represented by a formula, $R^4_{(1-s)}M^3_s$, in terms of a molar ratio, where $R^4$ is a rare earth element at least including one or more elements selected from the group consisting of Gd, Tb, Dy, Nd and Ho; $M^3$ is a metal element other than rare earth elements, which is alloyed with $R^4$, and an unavoidable impurity element; and the following is satisfied, $0.05 \le s \le 0.40$; and diffusing and permeating the first modifying material into the first rare earth magnet precursor.

6. The manufacturing method according to claim 5, further comprising:

preparing a second rare earth magnet precursor that includes a main phase and a particle boundary phase present around the main phase and in which an overall composition in terms of a molar ratio is represented by a formula, $(R^2_{(1-x)}R^1_x)_yFe_{(100-y-w-z-v)}Co_wB_zM^1_v$, where $R^1$ is one or more elements selected from the group consisting of Ce, La, Y, and Sc; $R^2$ is one or more elements selected from the group consisting of Nd and Pr; $M^1$ is one or more elements selected from the group consisting of Ga, Al, Cu, Au, Ag, Zn, In, and Mn, and an unavoidable impurity element; and the followings are satisfied, $0.1 \leq x \leq 1.0$, $12.0 \leq y \leq 20.0$, $5.0 \leq z \leq 20.0$, $0 \leq w \leq 8.0$, and $0 \leq v \leq 2.0$, and the main phase has a crystal structure of $R_2Fe_{14}B$, optionally having substitution and/or intrusion of an additional element, where R is a rare earth element, and an average particle size of the main phase is 0.1 μm to 20 μm;

preparing a second modifying material having a composition represented by a formula, $R^3(_{1-p})M^2_p$, in terms of a molar ratio, where $R^3$ is one or more elements selected from the group consisting of Nd and Pr; $M^2$ is a metal element other than rare earth elements, which is alloyed with $R^3$, and an unavoidable impurity element; and the following is satisfied, $0.05 \leq p \leq 0.40$; and diffusing and permeating the second modifying material into the second rare earth magnet precursor to obtain the first rare earth magnet precursor.

7. The manufacturing method according to claim 5, further comprising:

preparing a second rare earth magnet precursor powder that includes a main phase and a particle boundary phase present around the main phase and in which an overall composition in terms of a molar ratio is represented by a formula, $(R^2_{(1-x)}R^1_x)_yFe_{(100-y-w-z-v)}Co_wB_zM^1_v$, where $R^1$ is one or more elements selected from the group consisting of Ce, La, Y, and Sc; $R^2$ is one or more elements selected from the group consisting of Nd and Pr; $M^1$ is one or more elements selected from the group consisting of Ga, Al, Cu, Au, Ag, Zn, In, and Mn, and an unavoidable impurity element; and the followings are satisfied, $0.1 \leq x \leq 1.0$, $12.0 \leq y \leq 20.0$, $5.0 \leq z \leq 20.0$, $0 \leq w \leq 8.0$, and $0 \leq v \leq 2.0$, and the main phase has a crystal structure of $R_2Fe_{14}B$, optionally having substitution and/or intrusion of an additional element, where R is a rare earth element, and an average particle size of the main phase is 0.1 μm to 20 μm;

preparing a second modifying material powder having a composition represented by a formula, $R^3(_{1-p})M^2_p$, in terms of a molar ratio, where $R^3$ is one or more elements selected from the group consisting of Nd and Pr; $M^2$ is a metal element other than rare earth elements, which is alloyed with $R^3$, and an unavoidable impurity element; and the following is satisfied, $0.05 \leq p \leq 0.40$; and mixing the second rare earth magnet precursor powder with the second modifying material powder and sintering the mixture to obtain the first rare earth magnet precursor.

8. The manufacturing method according to claim 6, wherein a diffusion and permeation temperature of the first modifying material is lower than a diffusion and permeation temperature of the second modifying material or a diffusion and permeation temperature of the second modifying material powder.

9. The manufacturing method according to claim 5, wherein the x satisfies $0.5 \leq x \leq 1.0$.

10. The manufacturing method according to claim 5, wherein:

the $R^1$ is one or more elements selected from the group consisting of Ce and La;

the $R^2$ and the $R^3$ are Nd; and the $R^4$ is one or more elements selected from the group consisting of Tb and Nd.

* * * * *